US006151468A

United States Patent [19]

Kami et al.

[11] Patent Number: 6,151,468

[45] Date of Patent: Nov. 21, 2000

[54] ELECTROPHOTOGRAPHIC PHOTOCONDUCTOR

[75] Inventors: Hidetoshi Kami, Numazu; Tetsuro Suzuki, Fuji; Narihito Kojima; Hiroshi Nagame, both of Numazu; Hiroshi Tamura, Susono; Yohta Sakon; Hiroshi Ikuno, both of Numazu, all of Japan

[73] Assignee: Ricoh Company, Ltd., Yokohama, Japan

[21] Appl. No.: 09/447,950

[22] Filed: Nov. 29, 1999

Related U.S. Application Data

[63] Continuation of application No. 09/243,785, Feb. 3, 1999, Pat. No. 6,030,733.

[30] Foreign Application Priority Data

Feb. 3, 1998 [JP] Japan ..... 10-022102

[51] Int. Cl.[7] ..... G03G 15/00

[52] U.S. Cl. ..... 399/159

[58] Field of Search ..... 430/56; 399/159

[56] References Cited

U.S. PATENT DOCUMENTS

| | | | |
|---|---|---|---|
| 5,350,653 | 9/1994 | Shoshi et al. | 430/83 |
| 5,427,880 | 6/1995 | Tamura et al. | 430/83 |
| 5,486,438 | 1/1996 | Shoshi et al. | 430/83 |
| 5,492,784 | 2/1996 | Yoshikawa et al. | 430/56 |
| 5,853,935 | 12/1998 | Suzuki et al. | 430/83 |
| 5,871,876 | 2/1999 | Ikuno et al. | 430/96 |

*Primary Examiner*—Roland Martin

*Attorney, Agent, or Firm*—Oblon, Spivak, McClelland, Maier & Neustadt, P.C.

[57] ABSTRACT

An electrophotographic photoconductor including a photoconductive layer which is formed overlying an electroconductive substrate and which includes at least a charge transporting polymer material, wherein the photoconductive layer has a water vapor permeability not greater than about 200 $g \cdot m^{-2} \cdot 24\ h^{-1}$. The photoconductive layer may be a functionally separated photoconductive layer including a charge generating layer and a charge transporting layer which is formed overlying the charge generating layer and which includes the charge transporting polymer material, wherein the charge transporting layer has a water vapor permeability not greater than about 200 $g \cdot m^{-2} \cdot 24\ h^{-1}$.

2 Claims, 1 Drawing Sheet

ELECTROPHOTOGRAPHIC PHOTOCONDUCTOR

This application is a Continuation of application Ser. No. 09/243,785 filed on Feb. 3, 1999, now U.S. Pat. No. 6,030, 733.

BACKGROUND OF THE INVENTION

1. Field of the Invention

The present invention relates to an electrophotographic photoconductor, and more particularly to an electrophotographic photoconductor which is useful for copiers, facsimile machines, laser printers, digital printing plate manufacturing apparatus and the like.

2. Discussion of the Related Art

Electrophotographic recording methods using a photoconductor are widely used for copiers, facsimile machines, laser printers, digital printing plate manufacturing apparatus and the like. The methods include, for example, the following processes:

(1) charging a photoconductor;

(2) imagewise irradiating the photoconductor with light to form an electrostatic latent image;

(3) developing the latent image with a toner to form a toner image on the photoconductor;

(4) transferring the toner image onto an image receiving material such as receiving paper;

(5) fixing the toner image on the receiving material to form a fixed toner image; and (6) cleaning the photoconductor to perform the next image forming processes.

The requisites for electrophotographic photoconductors are, for example, as follows:

(1) having a good charging property so as to be charged to an appropriate electric potential in a dark place;

(2) having a good charge maintaining property such that the decrease of the electric potential is little in a dark place; and (3) having a good charge dissipating property such that the electric potential is rapidly dissipated by light irradiation.

Currently, in addition to these requisites, electrophotographic photoconductors are especially required to have the following requisites:

(4) having a relatively low cost;

(5) hardly causing environmental pollution; and (6) producing good images without image defects such as background fouling for a long time.

Conventionally, photoconductors including the following photoconductive layers are well known as an electrophotographic photoconductor:

(1) selenium photoconductive layers including selenium or a selenium alloy as a main component;

(2) inorganic photoconductive layers which include an inorganic photoconductive material such as zinc oxide or cadmium sulfide which is dispersed in a binder resin;

(3) amorphous silicon photoconductive layers which include an amorphous silicon material; and (4) organic photoconductive layers which include an organic photoconductive material.

Among these photoconductors, photoconductors having an organic photoconductive layer are widely used because they have a relatively low cost, various types of photoconductors can be designed and they hardly cause environmental pollution.

Organic photoconductors are broadly classified as follows:

(1) photoconductive resin type photoconductors which include a photoconductive resin such as polyvinyl carbazole;

(2) charge transfer complex type photoconductors which include a charge transfer complex such as polyvinyl carbazole-trinitrofluorenone;

(3) pigment dispersion type photoconductors which include an organic pigment such as phthalocyanine which is dispersed in a binder resin; and (4) functionally separated photoconductors which include a combination of a charge generating material and a charge transporting material.

Currently, among these organic photoconductors, functionally separated photoconductors attract considerable attention.

The mechanism of formation of an electrostatic latent image is as follows:

(1) when light irradiates a charged organic photoconductor, the light passes through a transparent charge transporting layer and is absorbed by a charge generating material included in a charge generating layer;

(2) the charge generating material which has absorbed the light generates a charge carrier;

(3) the charge carrier, which is injected to the charge transporting layer, moves through the charge transporting layer, which is caused by the electric field formed in the charged photoconductor; and (4) the charge carrier finally combines with the charge on the surface of the photoconductor, resulting in neutralization of the charge, and thereby an electrostatic latent image is formed.

Functionally separated photoconductors which include a combination of a charge transporting material which has absorbance mainly in an ultraviolet region and a charge generating material which has absorbance mainly in a visible region are well known and preferable. However, even in the functionally separated photoconductors, the durability is not necessarily satisfactory. As mentioned above, the electrophotographic photoconductors are recently required to have good durability. Therefore, it is very important for the electrophotographic photoconductors to continue to produce good images for a long period of time.

In order to continue to produce good images for a long period of time, it is essential to obtain techniques to prevent occurrence of image defects such as background fouling, and to prevent decrease of image density, even when used for a long time. It is well known that the image defects and the decrease of image density are respectively caused by faults on the surface of the photoconductors, and decrease of the electric potential or increase of the residual potential of the photoconductors after the light irradiation. However, an electrophotographic photoconductor, which has both of good abrasion resistance and good durability in charge properties, has not been developed, and it is especially desired.

In attempting to improve the abrasion resistance and the durability, various proposals have been made.

At first, the proposals which have been made to improve the abrasion resistance of the surface of the photoconductors are as follows:

(1) Abrasion Resistance Improving Methods by Improving Mechanical Strength of Charge Transporting Layer For example, Japanese Laid-Open Patent Publications Nos. 10-288846 and 10-239870 have disclosed photoconductors in which the abrasion resistance thereof is improved by using a polyacrylate resin as a binder resin.

Japanese Laid-Open Patent Publications Nos. 9-160264 and 10-239871 have disclosed photoconductors in which the abrasion resistance thereof is improved by using a polycarbonate resin as a binder resin.

Japanese Laid-Open Patent Publications Nos. 10-186688, 10-186687, and 5-040358 have disclosed photoconductors in which the abrasion resistance thereof is improved by using a polyester resin having a terphenyl skeleton, a polyester resin having a triphenyl methane skeleton, or a polyester resin having a fluorene skeleton as a binder resin.

(2) Abrasion Resistance Improving Methods by Decreasing Friction Coefficient of Charge Transporting Layer For example, Japanese Laid-Open Patent Publications Nos. 10-246978 and 10-20534 have disclosed photoconductors which have a relatively low friction coefficient by including a siloxane component. Japanese Laid-Open Patent Publications Nos. 5-265241 and 8-328286 have disclosed photoconductors which have a relatively low friction coefficient by including a particulate fluorine containing resin.

(3) Abrasion Resistance Improving Methods by Reinforcing Charge Transporting Layer For example, Japanese Laid-Open Patent Publications Nos. 1-129260 and 8-101517 have disclosed photoconductors in which the abrasion resistance thereof is improved by including a filler in a charge transporting layer.

Japanese Laid-Open Patent Publications Nos. 9-12637 and 9-235442 have disclosed photoconductors in which the abrasion resistance thereof is improved by using a polymer blend including a styrene elastomer as a binder resin in a charge transporting layer.

The photoconductors mentioned in (1) to (3) have to include a large amount of a charge transporting material having low molecular weight in the photoconductive layer because of obtaining a good light decaying property, i.e., good photosensitivity. To use a large amount of a charge transporting material having low molecular weight seriously deteriorates the strength of the photoconductive layer, and the more the charge transporting material is included in the photoconductive layer, the worse the abrasion resistance of the photoconductive layer. Therefore the photoconductive layers of these photoconductors easily abrade, which is caused by the charge transporting material having low molecular weight. Accordingly the methods mentioned above are not effective for the improvement of abrasion resistance of photoconductors.

Other methods, which have been disclosed to improve the abrasion resistance of the surface of the photoconductors, are as follows:

(4) Abrasion Resistance Improving Method by Providing Protective Layer

For example, Japanese Laid-Open Patent Publication No. 10-177268 discloses a photoconductor in which the abrasion resistance thereof is improved by providing a protective layer formed on a charge transporting layer.

However, when a protective layer is formed, an oxidizing material tends to stay on the surface of the photoconductor, resulting in sometimes occurrence of image defects such as image tailing. In addition, the sensitivity of the photoconductor tends to deteriorate, and therefore this method is not effective for the improvement of the abrasion resistance.

(5) Abrasion Resistance Improving Method Using Charge Transporting Polymer Material Japanese Laid-Open Patent Publication No. 7-325409 discloses a photoconductor which includes a charge transporting polymer material instead of charge transporting materials having low molecular weight. It is supposed that the photoconductor has good abrasion resistance because the content of resins in the photoconductive layer is relatively high. However, when the charge transporting polymer material is used in such an amount that the photoconductor has good abrasion resistance, another problem such as background fouling occurs. Thus, the photoconductor including a charge transporting polymer material cannot improve its abrasion resistance while stably producing images having good image qualities.

As mentioned above, there is no photoconductor which has good abrasion resistance and can stably produce good images.

On the other hand, proposals which have been made to improve the stability of the image qualities of images produced by photoconductors are as follows:

(6) Image Stability Improving Methods Using Antioxidant

For example, Japanese Laid-Open Patent Publications Nos. 57-122444 and 61-156052 have disclosed photoconductors which include an antioxidant in the photoconductive layer.

(7) Image Stability Improving Methods Using Plasticizer

For example, Japanese Laid-Open Patent Publications Nos. 8-272126 and 8-95278 have disclosed photoconductors which include a plasticizer in the photoconductive layer.

The methods mentioned in (6) and (7) are effective for the prevention of deterioration of the charge properties of the photoconductive layer when the photoconductor is used for a long time. When these compounds are used for a photoconductor which includes a binder resin and a charge transporting material having low molecular weight, since the charge transporting material is included therein in a large amount, only a small amount of these compounds can be added. Therefore, these methods are not effective for the improvement of the durability of the photoconductor. In addition, the charge transporting layer, which includes a charge transporting material, generally has a relatively low glass transition temperature, and when these compounds are added therein, the glass transition temperature decreases to a temperature which is almost the same as the inside temperature of an image forming apparatus in which the photoconductor is provided. Therefore, other problems such as deformation of the photoconductive layer and toner adhesion to the photoconductive layer tend to occur. Therefore, these methods are also not effective for the improvement of the durability of the photoconductor.

Therefore, a photoconductor which can produce images having good image qualities for a long period of time cannot be obtained by the techniques which have been conventionally proposed.

SUMMARY OF THE INVENTION

Accordingly, an object of the present invention is to provide an electrophotographic photoconductor which can produce good images without image defects such as background fouling even when a very large amount of images are produced.

To achieve such an object, the present invention contemplates the provision of an electrophotoconductor which is formed on an electroconductive substrate and which includes a photoconductive layer including a charge transporting polymer material, wherein the photoconductive layer has a specified water vapor permeability of not greater than about 200 $g \cdot m^{-2} \cdot 24\ h^{-1}$. The thickness of the photoconductive layer is preferably not greater than 40 $\mu$m.

Preferably the photoconductive layer includes a charge generating layer and a charge transporting layer which is formed overlying the charge generating layer and which includes a charge transporting polymer material, wherein the charge transporting layer has a water vapor permeability of not greater than about 200 $g \cdot m^{-2} \cdot 24\ h^{-1}$. The thickness of the charge transporting layer is preferably not greater than 40 $\mu$m.

The charge transporting polymer material preferably includes a charge transporting polymer material including a triarylamine structure and a polycarbonate structure.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
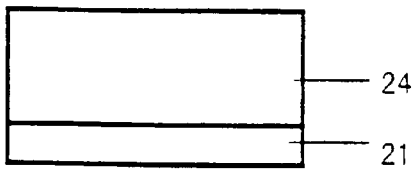
FIG. 1 is a schematic diagram illustrating a sectional view of an embodiment of the electrophotographic photoconductor of the present invention.

Generally, the present invention provides an electrophotoconductor which is formed on an electroconductive substrate and which includes a photoconductive layer including a charge transporting polymer material, wherein the photoconductive layer has a specified water vapor permeability of not greater than about 200 $g \cdot m^{-2} \cdot 24\ h^{-1}$.

Hereinafter the functionally separated photoconductors of the present invention are mainly explained, however the present invention is not limited thereto.

In the charge transporting layers of conventional functionally separated photoconductors, which include a charge transporting material having low molecular weight and a binder resin, the low molecular weight charge transporting material is dispersed in the binder resin in an amount of about 50% in order to obtain good photosensitivity. Therefore the charge transporting layers including a charge transporting material having low molecular weight (hereinafter referred to as low molecular weight charge transporting layers) are very brittle compared to a layer consisting of only the binder resin. When the layers are loaded with a mechanical stress, the photoconductive layers easily abrade, and faults such as cracks are easily formed therein. Various solutions have been proposed to improve this problem; however, the solutions are not effective for the problem.

Currently a charge transporting layer including a charge transporting polymer material (hereinafter referred to as a charge transporting polymer layer) has been studied. Since this charge transporting polymer layer need not include a low molecular weight charge transporting material, the durability of the charge transporting layer is drastically improved and the abrasion of the layer and the occurrence of faults in the layer can be decreased. However, the photoconductors having a charge transporting polymer layer has a problem in that the images produced by the photoconductors have background fouling. This is because the photoconductors including a charge transporting polymer layer have poor durability in electrostatic properties.

Therefore, there is no photoconductor which has a long life by having both the good mechanical durability and the good durability in electrostatic properties.

The reason for the background fouling is considered to be as follows:

A photoconductor is charged by applying a predetermined voltage thereto so as to have a predetermined potential in a charging process. The more the charge transporting layer is abraded, the greater the electric field strength of the charge transporting layer. When the electric field strength increases, charges tend to transfer toward the surface of the photoconductor even in an area of the photoconductor which is not exposed to light, resulting in occurrence of background fouling.

Even when there is little abrasion in the charge transporting layer, background fouling occurs if the charging ability of the charge transporting layer deteriorates by the decrease of electric resistance of the charge transporting layer, which is caused, for example, by exposure of the charge transporting layer to an oxidizing gas.

Therefore, in the charge transporting polymer layer, it is a key point how to prevent the deterioration of the charging ability of the layer.

When the present inventors have studied how to prevent the deterioration of the charging ability of the charge transporting polymer layer, the following knowledge can be obtained:

(1) The greater water vapor permeability the photoconductor has, the worse the charging ability thereof becomes when repeatedly used.

(2) The less water vapor permeability the photoconductor has, the less the decrease of the electric potential of the photoconductor becomes even when the photoconductor is exposed to gases such as ozone and NOx. Namely, the oxidizing materials such as ozone and NOx, which are generated by chargers in image forming apparatus, seem to deteriorate the charging ability of the photoconductor by penetrating into the charge transporting layer, even when the charge transporting layer is not abraded.

In addition, when the present inventors have studied why initial low molecular weight charge transporting layers have relatively good properties with respect to background fouling compared to charge transporting polymer layers, the following knowledge can be obtained:

(3) Low molecular weight charge transporting layers have a relatively small water vapor permeability compared to charge transporting polymer layers. From this fact, it is believed that the low molecular weight charge transporting material functions as a gas barrier in the charge transporting layer, and thereby the water vapor permeability of the charge transporting layer is decreased.

Then the present inventors have studied the water vapor permeability of charge transporting polymer layers including a low molecular weight compound such as antioxidants, plasticizers, lubricants, ultraviolet absorbing agents, low molecular weight charge transporting materials and the like. The results are as follows:

(4) The water vapor permeability of a charge transporting polymer layer can be drastically decreased by adding therein a small amount of a low molecular weight compound such as antioxidants, plasticizers and the like. In addition, the more the low molecular weight compound is added therein, the less the water vapor permeability of the charge transporting layer.

Further, the present inventors discover the following facts:

(5) The water vapor permeability of a charge transporting layer can be decreased by adding therein a resin having good barrier properties to gases. Alternatively, charge transporting materials, which are copolymerized with a resin having good barrier properties to gases, can also be used; and (6) The water vapor permeability of a charge transporting layer decreases as the charge transporting layer thickens.

In addition, the present inventors discover that when the water vapor permeability of a charge transporting layer is not greater than about 200 $g \cdot m^{-2} \cdot 24\ h^{-1}$, background fouling does not occur. When the water vapor permeability of a charge transporting layer becomes greater than about 200 $g \cdot m^{-2} \cdot 24\ h^{-1}$, background fouling increases proportionally to the water vapor permeability. This is true in photoconductors having a single photoconductive layer as well as in the functionally separated photoconductors.

As a result, it is discovered that the object of the present invention can be achieved by a photoconductor including at least a charge transporting polymer material, wherein the photoconductor has a water vapor permeability not greater than 200 $g \cdot m^{-2} \cdot 24\ h^{-1}$. Thereby, a charge transporting polymer material, which has good abrasion resistance but has a drawback in that images produced by the resultant photoconductor has background fouling, can be used as a material for photoconductors. Since a charge transporting polymer layer or a photoconductive layer including a charge transporting polymer material has excellent abrasion resistance, the water vapor permeability thereof hardly changes even when the photoconductor is used for a long time. Therefore, a photoconductor having excellent durability can be provided by using this technique. In addition, by using this technique, the photoconductive layer can be thinned, which results in improvement of resolution of images. Further, since the photoconductive layer has excellent durability, the photoconductor drum can be miniaturized, and thereby the image forming apparatus can be miniaturized.

The water vapor permeability can be freely controlled by one or more of the following methods:

(1) adding in a photoconductive layer a small amount of a low molecular weight compound such as antioxidants and the like;

(2) blending or copolymerizing a resin (or a component) having good barrier properties to gases with a charge transporting polymer material; and (3) thickening a photoconductive layer.

The suitable content of a low molecular weight compound in the charge transporting layer of a functionally separated photoconductor is not greater than about 30% by weight to continue to produce images having good image qualities. When the content is greater than about 30% by weight, the glass transition temperature of the charge transporting layer decreases and therefore the abrasion resistance thereof deteriorates.

The suitable content of a resin having good barrier properties to gases in the charge transporting layer of a functionally separated photoconductor is not greater than about 50% by weight to maintain good light decay properties of the photoconductor. Similarly, the suitable content of a component, which is copolymerized with a charge transporting polymer material and which has good barrier properties to gases, in the charge transporting layer of a functionally separated photoconductor is not greater than about 60% by weight to maintain good light decay properties of the photoconductor.

When two or more polymers are employed in a charge transporting layer, the water vapor permeability of the layer is almost the average value of the polymers. Therefore, when a polymer having a water vapor permeability not greater than 120 $g \cdot m^{-2} \cdot 24\ h^{-1}$ (the water vapor permeability of the polymer having the same thickness as that of the charge transporting layer) is used in a charge transporting layer, various charge transporting polymer materials can be combined. This is also true in a case when a component is copolymerized with a charge transporting polymer material.

In addition, the thickness of the charge transporting layer of the present invention is preferably not greater than 40 $\mu$m to obtain images having good resolution.

Next, charge transporting polymer materials for use in the present invention is explained. The following known polymers can be used as a charge transporting polymer material.

(a) Polymers Having a Carbazole Ring

For example, polyvinyl carbazole, and compounds which have been disclosed in Japanese Laid-Open Patent Publications Nos. 50-82056, 54-9632, 54-11737, 4-175337, 4-183719, and 6-234841 can be used.

(b) Polymers Having a Hydrazone Structure

For example, compounds which have been disclosed in Japanese Laid-Open Patent Publications Nos. 57-78402, 61-20953, 61-296358, 1-134456, 1-179164, 3-180851, 3-180852, 3-50555, 5-310904 and 6-234840 can be used.

(c) Polysilylene Compounds

For example, compounds which have been disclosed in Japanese Laid-Open Patent Publications Nos. 63-285552, 1-88461, 4-264130, 4-264131, 4-264132, 4-264133 and 4-289867 can be used.

(d) Polymers Having a Triarylamine Structure

For example, N, N-bis(4-methylphenyl)-4-amino polystyrene, and compounds which have been disclosed in Japanese Laid-Open Patent Publications Nos. 1-134457, 2-282264, 2-304456, 4-133065, 4-133066, 5-40350 and 5-202135 can be used.

(e) Other Polymers

For example, polycondensation products of nitropyrene with formaldehyde, and compounds which have been disclosed in Japanese Laid-Open Patent Publications Nos. 51-73888, 56-150749, 6-234836 and 6-234837 can be used.

The polymers having an electron donating group for use as the charge transporting material in the present invention are not limited the polymers mentioned above, and their copolymers (including block or graft copolymers) and star polymers with one or more known monomers can also be used. In addition, crosslinked polymers having an electron donating group disclosed in Japanese Laid-Open Patent Publication No. 3-109406.

Suitable compounds having a triarylamine structure, which are preferably used as a charge transporting polymer material, include compounds which have been disclosed in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

More preferably, the following compounds having a triarylamine structure can be used as a charge transporting polymer material in the present invention.

Specific examples of such charge transporting polymer materials include compounds having the following formulas (1) to (6).

Charge Transporting Polymer Materials Having Formula (1)

(1)

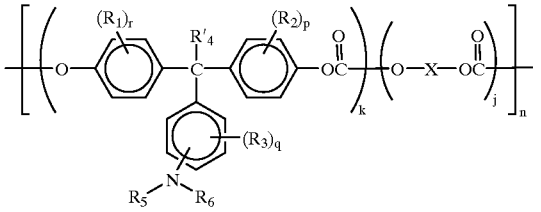

wherein $R_1$, $R_2$, and $R_3$ independently represent an alkyl group, a substituted alkyl group, or a halogen atom; $R_4$ represents a hydrogen atom, an alkyl group or a substituted alkyl group; $R_5$ and $R_6$ independently represent an aryl group or a substituted aryl group; p, q and r are independently 0 or an integer of from 1 to 4; k and j represent the mole fraction of the repeating units, and k is the number of from 0.1 to 1 ($0.1 \leqq k \leqq 1$) and j is the number of from 0 to 0.9 ($0 \leqq j \leqq 0.9$); n is an integer of from 5 to 5000; and X represents a divalent aliphatic group, a divalent alicyclic group, or a divalent group having the following formula:

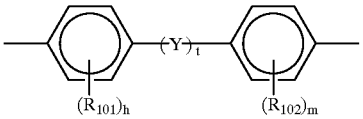

wherein $R_{101}$ and $R_{102}$ independently represent an alkyl group, a substituted alkyl group, an aryl group, a substituted aryl group or a halogen atom; m and h are 0 or an integer of from 1 to 4, and t is 0 or 1; and Y represents an alkylene group having 1 to 12 carbon atoms which may be linear, branched or cyclic, or a group of —O—, —S—, —SO—, —$SO_2$—, —CO—, or —CO—O—Z—O—CO— (Z represents a divalent aliphatic group), or Y may be the following group:

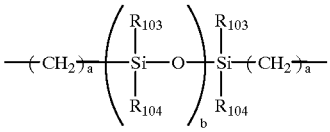

wherein a is an integer of from 1 to 20 and b is an integer of from 1 to 2000; and $R_{103}$ and $R_{104}$ independently represent an alkyl group, a substituted alkyl group, an aryl group, or a substituted aryl group, wherein $R_{101}$, $R_{102}$, $R_{103}$ and $R_{104}$ may be the same or different from each other.

The alkyl group and the substituted alkyl group for use as the groups $R_1$, $R_2$ and $R_3$ include a linear or branched alkyl group having carbon atoms of from 1 to 12, preferably from 1 to 8 and more preferably from 1 to 4. These alkyl groups may include a fluorine atom, a hydroxy group, a cyano group, an alkoxy group having from 1 to 4 carbon atoms, a phenyl group, or a phenyl group which is substituted with a halogen atom, an alkyl group having from 1 to 4 carbon atoms, or an alkoxy group having from 1 to 4 carbon atoms. Specific examples of such alkyl groups include a methyl group, an ethyl group, a n-propyl group, an i-propyl group, a t-butyl group, a s-butyl group, a n-butyl group, an i-butyl group, a trifluoromethyl group, a 2-hydroxyethyl group, a 2-cyanoethyl group, a 2-ethoxyethyl group, a 2-methoxyethyl group, a benzyl group, a 4-chlorobenzyl group, a 4-methylbenzyl group, 4-methoxybenzyl group, 4-phenyl benzyl group and the like.

Specific examples of the halogen atom for use as the groups $R_1$, $R_2$ and $R_3$ include a fluorine atom, chlorine atom, bromine atom, and iodine atom.

The alkyl group or the substituted alkyl group for use as the group $R_4$ include the alkyl groups or the substituted alkyl groups mentioned above for use as the groups $R_1$, $R_2$ and $R_3$.

Specific examples of the aryl groups or substituted aryl groups for use as the groups $R_5$ and $R_6$ include aromatic hydrocarbon groups such as a phenyl group; condensed polycyclic groups such as a naphthyl group, a pyrenyl group, a 2-fluorenyl group, a 9,9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; non-condensed polycyclic groups such as a biphenyl group, and terphenyl group; and the like.

Specific examples of the heterocyclic groups for use as the groups $R_5$ and $R_6$ include a thienyl group, a benzo thienyl group, a furyl group, a benzofuranyl group, a carbazolyl group and the like.

The aryl groups mentioned above may include one or more of the following substituents.

(1-1) a halogen atom, a trifluoromethyl group, a cyano group, and a nitro group.

(1-2) an alkyl group which is mentioned above for use as the groups $R_1$, $R_2$ and $R_3$.

(1-3) an alkoxy group (—$OR_{105}$), in which $R_{105}$ represents an alkyl group mentioned above for use as the groups $R_1$, $R_2$ and $R_3$, such as a methoxy group, an ethoxy group, a n-propoxy group, an i-propoxy group, a t-butoxy group, a n-butoxy group, a s-butoxy group, an i-butoxy group, a 2-hydroxyethoxy group, a 2-cyanoethoxy group, a benzyloxy group, a 4-methylbenzyloxy group, a trifluoromethoxy group, and the like.

(1-4) an aryloxy group, in which the aryl group is a phenyl group and a naphthyl group. The aryloxy group may include an alkoxy group having from 1 to 4 carbon atoms, an alkyl group having from 1 to 4 carbon atoms or a halogen atom as a substituent. Specific examples of such an aryloxy group include a phenoxy group, a 1-naphthyloxy group, a 2-naphthyloxy group, a 4-methylphenoxy group, a 4-methoxyphenoxy group, a 4-chlorophenoxy group, a 6-methyl-2-naphthyloxy group, and the like.

(1-5) a substituted mercapto group or an arylmercapto group such as a methylthio group, an ethylthio group, a phenylthio group, a p-methylphenylthio group, and the like.

(1-6) an amino group substituted with an alkyl group, in which the alkyl group is mentioned above for use as the groups $R_1$, $R_2$ and $R_3$. Specific examples of such amino groups include a dimethylamino group, a diethyl amino group, an N-methyl-N-propylamino group, an N, N-dibenzylamino group and the like.

(1-7) an acyl group such as an acetyl group, a propionyl group, a butylyl group, a malonyl group, a benzoyl group and the like.

The group X can be incorporated in the main chain of the compounds having formula (1) by polymerizing a diol compound which includes a triarylamino group and which has a formula (A) described below with a diol compound having a formula (B) described below, using a phosgene method, an ester interchanging method or the like. In this case, the resultant polycarbonate resins are random copolymers or block copolymers. In addition, the group X can be incorporated in the main chain of the compounds having formula (1) by polymerizing a diol compound which includes a triarylamino group and which has formula (A) with a bischloroformate derived from a diol compound having formula (B). In this case, the resultant polycarbonate resins are alternant copolymers.

(A)

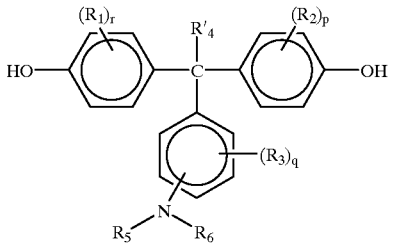

(B)

Specific examples of the diol compounds having formula (B) include the following compounds:

aliphatic diols such as 1 ,3-propanediol, 1,4-butanediol, 1,5-pentanediol, 1,6-hexanediol, 1,8-octanediol, 1,10-decanediol, 2-ethyl-1,3-propanediol, 2,2-dimethyl-1,3-propanediol, 2-ethyl-1,3-propanediol, diethylene glycol, triethylene glycol, polyethylene glycol and polytetramethyleneether glycol; alicyclic diols such as 1,4-cyclohexane diol, 1,3-cyclohexane diol, and cyclohexane-1,4-dimethanol; and aromatic diols such as 4,4'-dihydroxydiphenyl, bis(4-hydroxyphenyl) methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl) cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl- 4,4'-dihydroxydiphenylsulfide, 4,4'-dihydroxydiphenyloxide, 2,2-bis(4-hydroxyphenyl) hexafluoropropane, 9,9-bis(4-hydroxyphenyl)fluorene, 9,9-bis(4-hydroxyphenyl)xanthene, ethyleneglycol-bis (4-hydroxybenzoate), diethyleneglycol-bis(4-hydroxybenzoate), triethyleneglycol-bis(4-hydroxybenzoate), 1,3-bis(4-hydroxyphenyl) tetramethyldisiloxane, phenol modified silicone oil and the like.

Charge Transporting Polymer Materials Having Formula (2)

(2)

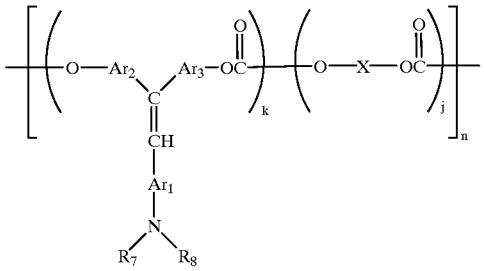

wherein $R_7$ and $R_8$ independently represent an aryl group or a substituted aryl group; $Ar_1$, $Ar_2$ and $Ar_3$ independently represent an arylene group; and X, k, j and n are defined above in formula (1).

Specific examples of an aryl group and a substituted aryl group for use as the groups $R_7$ and $R_8$ include aromatic hydrocarbon groups such as a phenyl group; condensed polycyclic groups such as a naphthyl group, a pyrenyl group, a 2-f luorenyl group, a 9,9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; non-condensed polycyclic groups such as a biphenyl group, and a terphenyl group; or the following group:

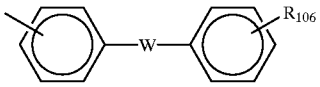

wherein W represents —O—, —S—, —SO—, —$SO_2$—, —CO—, or the following divalent groups:

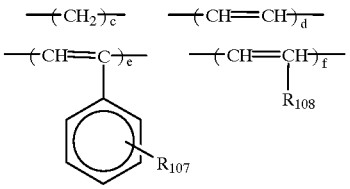

wherein c is an integer of from 1 to 12, and d, e and f are independently an integer of from 1 to 3.

Specific examples of the heterocyclic groups for use as the groups $R_7$ and $R_8$ include a thienyl group, a benzo thienyl group, a furyl group, a benzofuranyl group, and a carbazolyl group.

Specific examples of the arylene group for use as the groups $Ar_1$, $Ar_2$ and $Ar_3$ include divalent groups of the aryl groups for use as the groups $R_7$ and $R_8$.

The aryl groups and arylene group mentioned-above may include a substituent which is used as the group $R_{106}$, $R_{107}$ or $R_{108}$ in the formulas described above. Specific examples of such a substituent include the following substituents.

(2-1) a halogen atom, a trifluoromethyl group, a cyano group and a nitro group.

(2-2) alkyl groups described above for use in formula (1).

(2-3) alkoxy groups described above for use in formula (1).

(2-4) aryloxy groups described above for use in formula (1).

(2-5) mercapto groups and substituted mercapto groups described above for use in formula (1).

(2-6)

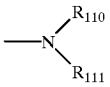

wherein $R_{110}$ and $R_{111}$ independently represent an alkyl group defined above in (1-2) or an aryl group. Specific examples of such an aryl group include a phenyl group, a biphenyl group, and a naphthyl group, each of which may include a substituent such as an alkoxy group having from 1 to 4 carbon atoms, an alkyl group having from 1 to 4 carbon atoms, or a halogen atom. These substituents may form a ring in combination with a carbon atom included in the aryl group. Specific examples of the group (2-6) include a diethyl amino group, an N-methyl-N-phenylamino group, an N,N-diphenylamino group, an N,N-di(p-tolyl)amino group, a dibenzylamino group, a piperidino group, a morpholino group, a julolidyl group and the like.

(2-7) an alkylenedioxy group such as a methylenedioxy group, and an alkylenedithio group such as a methylenedithio group.

The group X can be incorporated in the main chain of the compounds having formula (2) by polymerizing a diol compound which includes a triarylamino group and which has a formula (C) described below with a diol compound having a formula (B) described below, using a phosgene method, an ester interchanging method or the like. In this case, the resultant polycarbonate resins are random copolymers or block copolymers. In addition, the group X can be incorporated in the main chain of the compounds having formula (2) by polymerizing a diol compound which includes a triarylamino group and which has formula (C) with a bischloroformate derived from a diol compound having formula (B). In this case, the resultant polycarbonate resins are alternant copolymers.

(C)

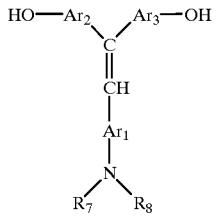

(B)

Specific examples of the diol compounds having formula (B) include diol compounds described above for use in the compounds having formula (1).

Charge Transporting Polymer Materials Having Formula (3)

(3)

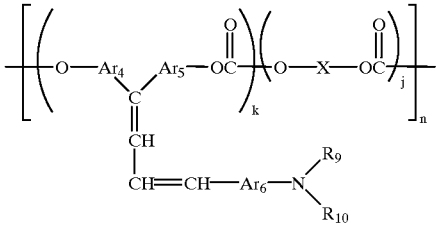

wherein $R_9$ and $R_{10}$ independently represent an aryl group or a substituted aryl group; $Ar_4$, $Ar_5$ and $Ar_6$ independently represent an arylene group; and X, k, j and n are defined above in formula (1).

Specific examples of an aryl group and a substituted aryl group for use as the groups $R_9$ and $R_{10}$ include aromatic hydrocarbon groups such as a phenyl group; condensed polycyclic groups such as a naphthyl group, a pyrenyl group, a 2-fluorenyl group, a 9,9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; and non-condensed polycyclic groups such as a biphenyl group, and a terphenyl group.

Specific examples of the heterocyclic groups for use as the groups $R_9$ and $R_{10}$ include a thienyl group, a benzo thienyl group, a furyl group, a benzofuranyl group, and a carbazolyl group.

Specific examples of the arylene group for use as the groups $Ar_4$, $Ar_5$ and $Ar_6$ include divalent groups of the aryl groups for use as the groups $R_9$ and $R_{10}$.

The aryl groups and arylene group mentioned above may include a substituent. Specific examples of such a substituent include the following substituents.

(3-1) a halogen atom, a trifluoromethyl group, a cyano group and a nitro group.

(3-2) alkyl groups described above for use in formula (1).

(3-3) alkoxy groups described above for use in formula (1).

(3-4) aryloxy groups described above for use in formula (1).

(3-5) mercapto groups and substituted mercapto groups described above for use in formula (1).

(3-6) amino groups substituted with an alkyl group which is defined above in (3-2). Specific examples of such amino groups include a dimethylamino group, a diethylamino group, an N-methyl-N-propylamino group, an N,N-dibenzylamino group, and the like.

(3-7) an acyl group such as an acetyl group, a propionyl group, a butyryl group, a malonyl group, a benzoyl group and the like.

The group X can be incorporated in the main chain of the compounds having formula (3) by polymerizing a diol compound which includes a triarylamino group and which has a formula (D) described below with a diol compound having a formula (B) described below, using a phosgene method, an ester interchanging method or the like. In this case, the resultant polycarbonate resins are random copolymers or block copolymers. In addition, the group X can be incorporated in the main chain of the compounds having formula (3) by polymerizing a diol compound which includes a triarylamino group and which has formula (D) with a bischloroformate derived from a diol compound having formula (B). In this case, the resultant polycarbonate resins are alternant copolymers.

(D)

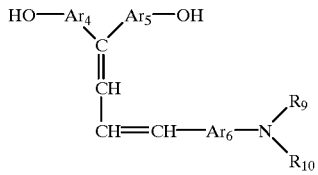

(B)

Specific examples of the diol compounds having formula (B) include diol compounds described above for use in formula (1).

Charge Transporting Polymer Materials Having Formula (4)

(4)

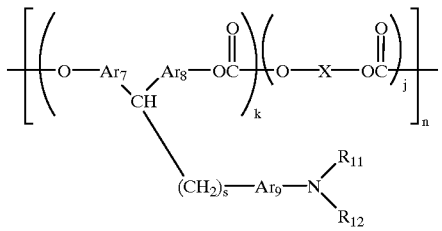

wherein $R_{11}$ and $R_{12}$ independently represent an aryl group or a substituted aryl group; $Ar_7$, $Ar_8$ and $Ar_9$ independently represent an arylene group; s is an integer of from 1 to 5; and X, k, j and n are defined above in formula (1).

Specific examples of an aryl group and a substituted aryl group for use as the groups $R_{11}$ and $R_{12}$ include aromatic hydrocarbon groups such as a phenyl group; condensed polycyclic groups such as a naphthyl group, a pyrenyl group, a 2-fluorenyl group, a 9, 9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; and non-condensed polycyclic groups such as a biphenyl group, and a terphenyl group.

Specific examples of the heterocyclic groups for use as the groups $R_{11}$ and $R_{12}$ include a thienyl group, a benzo thienyl group, a furyl group, a benzofuranyl group, and a carbazolyl group.

Specific examples of the arylene group for use as the groups $Ar_7$, $Ar_8$ and $Ar_9$ include divalent groups of the aryl groups for use as the groups $R_{11}$ and $R_{12}$.

The aryl groups and arylene group mentioned above may include a substituent. Specific examples of such a substituent include the following substituents.

(4-1) a halogen atom, a trifluoromethyl group, a cyano group and a nitro group.

(4-2) alkyl groups described above for use in formula (1).

(4-3) alkoxy groups described above for use in formula (1).

(4-4) aryloxy groups described above for use in formula (1).

(4-5) mercapto groups and substituted mercapto groups described above for use in formula (1).

(4-6) amino groups substituted with an alkyl group which is defined above in (3-2). Specific examples of such amino groups include a dimethylamino group, a diethylamino group, an N-methyl-N-propylamino group, an N,N-dibenzylamino group, and the like.

(4-7) an acyl group such as an acetyl group, a propionyl group, a butyryl group, a malonyl group, a benzoyl group and the like.

The group X can be incorporated in the main chain of the compounds having formula (4) by polymerizing a diol compound which includes a triarylamino group and which has a formula (E) described below with a diol compound having a formula (B) described below, using a phosgene method, an ester interchanging method or the like. In this case, the resultant polycarbonate resins are random copolymers or block copolymers. In addition, the group X can be incorporated in the main chain of the compounds having formula (4) by polymerizing a diol compound which includes a triarylamino group and which has formula (E) with a bischloroformate derived from a diol compound having formula (B). In this case, the resultant polycarbonate resins are alternant copolymers.

(E)

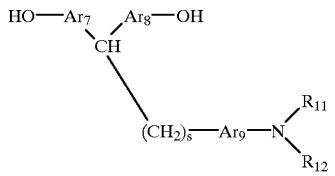

(B)

Specific examples of the diol compounds having formula (B) include diol compounds described above for use in formula (1).

Charge Transporting Polymer Materials Having Formula (5)

(5)

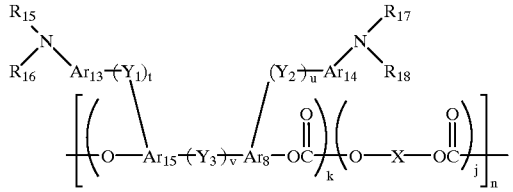

wherein $R_{15}$, $R_{16}$, $R_{17}$ and $R_{18}$ independently represent an aryl group or a substituted aryl group; $Ar_{13}$, $Ar_{14}$, $Ar_{15}$, and $Ar_{16}$ independently represent an arylene group; $Y_1$, $Y_2$ and $Y_3$ independently represent an alkylene group or a substituted alkylene group; t, u and v are independently 0 or 1; and X, k, j and n are defined above in formula (1).

Specific examples of an aryl group and a substituted aryl group for use as the groups $R_{15}$, $R_{16}$, $R_{17}$ and $R_{18}$ include aromatic hydrocarbon groups such as a phenyl group; condensed polycyclic groups such as a naphthyl group, a pyrenyl group, a 2-fluorenyl group, a 9,9-dimethyl-2-fluorenyl group, an azulenyl group, an anthryl group, a triphenylenyl group, a chrysenyl group, a fluorenylidenephenyl group, and a 5H-dibenzo(a,dlcycloheptenylidenephenyl group; and non-condensed polycyclic groups such as a biphenyl group, and a terphenyl group.

Specific examples of the heterocyclic groups for use as the groups $R_{15}$, $R_{16}$, $R_{17}$ and $R_{18}$ include a thienyl group, a benzo thienyl group, a furyl group, a benzofuranyl group, and a carbazolyl group.

Specific examples of the arylene group for use as the groups $Ar_{13}$, $Ar_{14}$, $Ar_{15}$ and $Ar_{16}$ include divalent groups of the aryl groups for use as the groups $R_{15}$, $R_{16}$, $R_{17}$ and $R_{18}$.

The aryl groups and arylene groups mentioned above may include a substituent. Specific examples of such a substituent include the following substituents.

(5-1) a halogen atom, a trifluoromethyl group, a cyano group and a nitro group.

(5-2) alkyl groups described above for use in formula (1).

(5-3) alkoxy groups described above for use in formula (1).

(5-4) aryloxy groups described above for use in formula (1).

The groups $Y_1$, $Y_2$, $Y_3$ independently represent an alkylene group, a substituted alkylene group, a cycloalkylene group, a substituted alkylene group, an alkyleneether group, a substituted alkyleneether group, —O—, —S— or —CH═CH—.

The alkylene group for use as the groups $Y_1$, $Y_2$ and $Y_3$ include a divalent group derived from the alkyl groups defined above in (5-2). Specific examples of such an alkylene group include a methylene group, an ethylene group, a 1,3-propylene group, a 1,4-butylene group, a 2-methyl-1,3-propylene group, a difluoromethylene group, a hydroxyethylene group, a cyanoethylene group, a methoxyethylene group, a phenylmethylene group, a 4-methylphenylmethylene group, a 2,2-propylene group, a 2,2-butylene group, a diphenylmethylene group, and the like. Specific examples of such a cycloalkylne group for use as the groups $Y_1$, $Y_2$ and $Y_3$ include a 1,1-cyclopentylene group, a 1,1-cyclohexylene group, 1,1-cyclooxylene group, and the like. Specific examples of such an alkyleneether for use as the groups $Y_1$, $Y_2$ and $Y_3$ include a dimethyleneether group, a diethyleneether group, an ethylenemethyleneether group, a bis(triethylene)ether group, a polytetramethyleneether group, and the like.

The group X can be incorporated in the main chain of the compounds having formula (5) by polymerizing a diol compound which includes a triarylamino group and which has a formula (G) described below with a diol compound having a formula (B) described below, using a phosgene method, an ester interchanging method or the like. In this case, the resultant polycarbonate resins are random copolymers or block copolymers. In addition, the group X can be incorporated in the main chain of the compounds having formula (5) by polymerizing a diol compound which includes a triarylamino group and which has formula (G) with a bischloroformate derived from a diol compound having formula (B). In this case, the resultant polycarbonate resins are alternant copolymers.

(G)

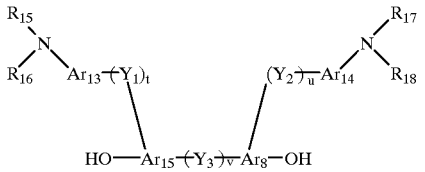

(B)

Specific examples of the diol compounds having formula (B) include diol compounds described above for use in formula (1).

Charge Transporting Polymer Materials Having Formula (6)

(6)

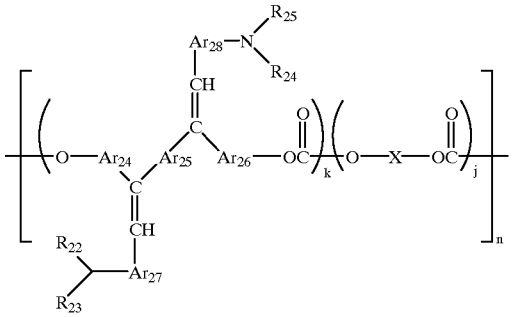

wherein $R_{22}$, $R_{23}$, $R_{24}$ and $R_{25}$ independently represent an aryl group or a substituted aryl group; $Ar_{24}$, $Ar_{25}$, $Ar_{26}$, $Ar_{27}$, and $Ar_{28}$ independently represent an arylene group; and X, k, j and n are defined above in formula (1).

Specific examples of an aryl group and a substituted aryl group for use as the groups $R_{22}$, $R_{23}$, $R_{24}$ and $R_{25}$ include aromatic hydrocarbon groups such as a phenyl group; condensed polycyclic groups such as a naphthyl group, a pyrenyl group, a 2-fluorenyl group, a 9,9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; and non-condensed polycyclic groups such as a biphenyl group, and a terphenyl group.

Specific examples of the heterocyclic groups for use as the groups $R_{22}$, $R_{23}$, $R_{24}$ and $R_{25}$ include a thienyl group, a benzo thienyl group, a furyl group, a benzofuranyl group, and a carbazolyl group.

Specific examples of the arylene group for use as the groups $Ar_{24}$, $Ar_{25}$, $Ar_{26}$, $Ar_{27}$ and $Ar_{28}$ include divalent groups of the aryl groups for use as the groups $R_{22}$, $R_{23}$, $R_{24}$ and $R_{25}$.

The aryl groups and arylene group mentioned above may include a substituent. Specific examples of such a substituent include the following substituents.

(6-1) a halogen atom, a trifluoromethyl group, a cyano group and a nitro group.

(6-2) alkyl groups described above for use in formula (1).

(6-3) alkoxy groups described above for use in formula (1).

(6-4) aryloxy groups described above for use in formula (1).

(6-5) mercapto groups and substituted mercapto groups described above for use in formula (1).

(6-6) amino groups substituted with an alkyl group which is defined above in (6-2). Specific examples of such amino groups include a dimethylamino group, a diethylamino group, an N-methyl-N-propylamino group, an N,N-dibenzylamino group, and the like.

(6-7) an acyl group such as an acetyl group, a propionyl group, a butyryl group, a malonyl group, a benzoyl group and the like.

The group X can be incorporated in the main chain of the compounds having formula (6) by polymerizing a diol compound which includes a triarylamino group and which has a formula (L) described below with a diol compound having a formula (B) described below, using a phosgene method, an ester interchanging method or the like. In this case, the resultant polycarbonate resins are random copolymers or block copolymers. In addition, the group X can be incorporated in the main chain by polymerizing a diol compound which includes a triarylamino group and which has formula (L) with a bischloroformate derived from a diol compound having formula (B). In this case, the resultant polycarbonate resins are alternant copolymers.

(L)

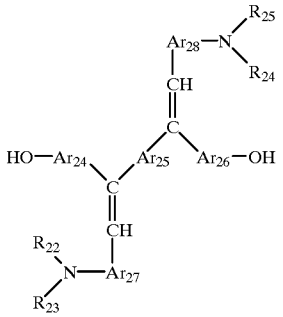

(B)

Specific examples of the diol compounds having formula (B) include diol compounds described above for use in formula (1).

Other polycarbonate resins having a branched chain having a triarylamine structure for use as the charge transporting material in the present invention include compounds disclosed in Japanese Laid-Open Patent Publications Nos. 6-234838, 6-234839, 6-295077, 7-325409, 9-297419, 9-80783, 9-80784, 9-80772 and 9-265201.

In the charge transporting polymer materials, a repeating unit having an electrically inactive structure is made by a monomer having a structure which does not exhibit photoconductivity. Specific examples of such a repeating unit include those described above in formula (B).

Hereinafter the electrophotographic photoconductor of the present invention is explained referring to drawings.

FIG. 1 is a schematic view illustrating a cross section of an embodiment of the electrophotographic photoconductor of the present invention. A photoconductive layer 24 is formed on an electroconductive substrate 21.

Figure 2:
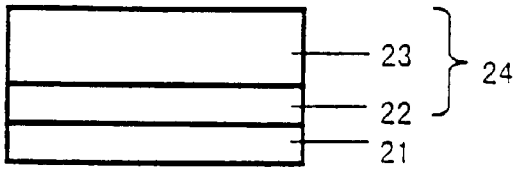
FIG. 2 is a schematic diagram illustrating a sectional view of another embodiment of the electrophotographic photoconductor of the present invention.

FIG. 2 is a schematic view illustrating a cross section of another embodiment of the electrophotographic photoconductor of the present invention. A charge generating layer 22 and a charge transporting layer 23 are overlaid on an electroconductive substrate 21 to form a photoconductive layer 24.

Figure 3:
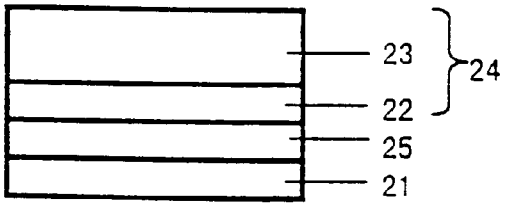
FIG. 3 is a schematic diagram illustrating a sectional view of yet another embodiment of the electrophotographic photoconductor of the present invention.

FIG. 3 is a schematic view illustrating a cross section of yet another embodiment of the electrophotographic photoconductor of the present invention. An undercoat layer 25 is formed between a photoconductive layer 24 and an electroconductive substrate 21. The photoconductive layer 24 includes a charge generating layer 22 and a charge transporting layer 23.

Figure 4:
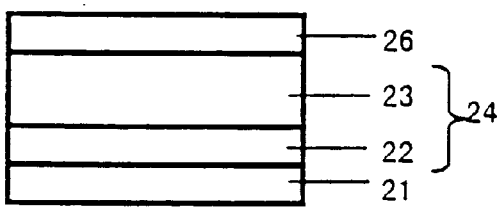
FIG. 4 is a schematic diagram illustrating a sectional view of a further embodiment of the electrophotographic photoconductor of the present invention.

FIG. 4 is a schematic view illustrating a cross section of still another embodiment of the electrophotographic photoconductor of the present invention. A protective layer 26 is formed on a photoconductive layer 24. The photoconductive layer 24 includes a charge generating layer 22 and a charge transporting layer 23.

Figure 5:
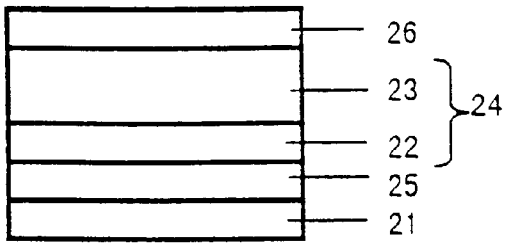
FIG. 5 is a schematic diagram illustrating a sectional view of a still further embodiment of the electrophotographic photoconductor of the present invention.

FIG. 5 is a schematic view illustrating a cross section of a further embodiment of the electrophotographic photoconductor of the present invention. An undercoat layer 25 is formed between a photoconductive layer 24 and an electroconductive substrate 21. In addition, a protective layer 26 is formed on the photoconductive layer 24. The photoconductive layer 24 includes a charge generating layer 22 and a charge transporting layer 23.

Suitable materials for use as the electroconductive substrate 21 include materials having a volume resistivity not greater than $10^{10}$ Ω·cm. Specific examples of such materials include plastics or paper, which are sheet-shaped, drum-shaped and the like and which are coated with a metal such as aluminum, nickel, chromium, nichrome, copper, silver, gold, platinum and iron, or an oxide such as tin oxide and indium oxide, by an evaporation method or a sputtering method; a plate of a metal such as aluminum, aluminum alloys, nickel and stainless steel; and a drum of such a metal in which a primary drum is made by a method such as a Drawing Ironing method, an Impact Ironing method, an Extruded Ironing method, an Extruded Drawing method or a cutting method, and then the primary drum is subjected to surface treatment by cutting, super finishing, polishing or the like.

The photoconductive layer 24 may be a single-layer type photoconductive layer in which a charge generating material is dispersed in a charge transporting layer, or a multi-layer type photoconductive layer in which a charge generating layer and a charge transporting layer are overlaid.

At first a multi-layer type photoconductive layer is explained.

The charge generating layer 22 mainly includes a charge generating material and, if necessary, a binder resin. Suitable charge generating materials include inorganic materials and organic materials.

Specific examples of such inorganic charge generating materials include crystalline selenium, amorphous selenium, selenium-tellurium, selenium-tellurium-halogen, selenium-arsenic compounds, amorphous silicon and the like. Suitable amorphous silicons include ones in which a dangling bond is terminated with a hydrogen atom or a halogen atom, or in which a boron atom or a phosphorus atom is doped.

Specific examples of the organic charge generating materials include phthalocyanine pigments such as metal phthalocyanine and metal-free phthalocyanine, azulenium pigments, squaric acid methine pigments, azo pigments including a carbazole skeleton, azo pigments including a triphenylamine skeleton, azo pigments including a diphenylamine skeleton, azo pigments including a dibenzothiophene skeleton, azo pigments ncluding a fluorenone skeleton, azo pigments including an oxadiazole skeleton, azo pigments including a bisstilbene skeleton, azo pigments including a distyryloxadiazole skeleton, azo pigments including a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like.

These charge transporting materials can be used alone or in combination.

Suitable binder resins, which are optionally used in the charge generating layer 22, include polyamide resins, poly urethane resins, epoxy resins, polyketone resins, polycarbonate resins, polyarylate resins, silicone resins, acrylic resins, polyvinyl butyral resins, polyvinyl formal resins, polyvinyl ketone resins, polystyrene resins, poly-N-vinylcarbazole resins, polyacrylamide resins, and the like. The charge transporting polymer materials mentioned above can also be used as a binder resin in the charge generating layer 22. If desired, a low molecular weight charge transporting material can also be added in the charge generating layer 22.

Suitable low molecular weight charge transporting materials for use in the charge generating layer 22 include positive hole transporting materials and electron transporting materials.

Specific examples of such electron transporting materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like. These electron transporting materials can be used alone or in combination.

Specific examples of such positive hole transporting materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like. These positive hole transporting materials can be used alone or in combination.

Suitable methods for forming the charge generating layer 22 include thin film forming methods in a vacuum, and coating methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like.

The coating methods useful for forming the charge generating layer 22 include, for example, the following steps;

(1) preparing a coating liquid by mixing one or more charge generating materials mentioned above with a solvent such as tetrahydrofuran, cyclohexanone, dioxane, dichloroethane, butanone and the like, and if necessary, together with a binder resin and an additives, and then dispersing the materials with a ball mill, an attritor, a sand mill or the like;

(2) coating on a substrate the coating liquid, which is diluted if necessary, by a dip coating method, a spray coating method, a bead coating method, or the like; and (3) drying the coated liquid to form a charge generating layer.

The thickness of the charge generating layer 22 is preferably from about 0.01 to about 5 μm, and more preferably from about 0.05 to about 2 μm.

Next, the charge transporting layer 23 is explained.

The charge transporting layer 23 is a layer including at least a charge transporting polymer material. The charge transporting layer 23 can be formed by coating a coating liquid which is prepared by dissolving or dispersing the charge transporting polymer material in a proper solvent, and then coating the coating liquid and drying the coated liquid. The charge transporting materials mentioned above can be used as the charge transporting polymer materials in the charge transporting layer 23. If desired, an antioxidant, a lasticizer, a lubricant, an ultraviolet absorbing agent, a eveling agent, a low molecular weight charge transporting material and the like, which preferably have molecular weight less than 10,000, can be added therein. These materials can be added alone or in combination. The content of the low molecular weight charge transporting material in the charge transporting layer is preferably from about 0.1 to about 30 parts by weight per 100 parts by weight of the charge transporting polymer material included in the charge transporting layer 23. The content of the leveling agent in the charge transporting layer 23 is preferably from about 0.001 to about 5 parts by weight per 100 parts by weight of the charge transporting polymer material included in the charge transporting layer 23. The thickness of the charge transporting layer 23 is preferably from about 5 to about 100 $\mu$m, and more preferably from about 10 to about 40 $\mu$m.

Suitable antioxidants for use in the charge transporting layer 23 include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl- 4'-hydroxyphenyl)propionate]methane, bis[3,3'-bis(4'-hydroxy-3'-t-butylphenyl)butyric acid]glycol ester, tocophenol compounds, and the like.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic Sulfur-including Compounds dilauryl-3,3'-thiodipropionate, distearyl-3,3'-thiodipropionate, ditetradecyl-3,3'-thiodipropionate, and the like.

(e) Organic Phosphorus-containing Compounds triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the charge transporting layer 23 include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Aliphatic Dibasic Acid Esters dibutyl adipate, di-n-hexyl adipate, di-2-ethylhexyl adipate, d-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-containing Compounds chlorinated paraffin, chlorinated diphenyl, methyl ester of chlorinated fatty acids, methyl ester of methoxychlorinated fatty acid, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the charge transporting layer 23 include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides stearyl amide, palmityl amide, oleyl amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the charge transporting layer 23 include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (metal complexes)

nickel(2,2'-thiobis(4-t-octyl)phenolate)-n-butylamine, nickeldibutyldithiocarbamate, cobaltdicyclohexyldithiophosphate, and the like.

(f) HALS (hindered amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Suitable low molecular weight charge transporting materials for use in the charge transporting layer 23 include those described above for use in the charge generating layer 22.

Suitable leveling agents for use in the charge transporting layer 23 include silicone oils such as dimethyl silicone oils, methyl phenyl silicone oils, and polymers or oligomers having a perfluoro group, but are not limited thereto.

If desired, the charge transporting layer 23 may include one or more polymers other than one or more charge transporting polymer materials.

Specific examples of such polymers include thermoplastic resins and thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, polycarbonate resins, cellulose acetate resins, ethylcellulose resins, polyvinyl butyral resins, polyvinyl formal resins, polyvinyl toluene resins, poly-N-vinylcarbazole resins, acrylic resins, silicone resins, fluorine-containing resins, epoxy resins, melamine resins, urethane resins, phenolic resins, alkyd resins, and the like, but are not limited thereto.

In particular, when a polymer is used for decreasing the water vapor permeability of the charge transporting layer 23, polyester resins, polycarbonate resins, acrylic resins, polystyrene resins, polyvinyl chloride resins, polyvinylidene chloride resins, polyethylene resins, polypropylene resins, fluorine-containing resins, polyacrylonitrile resins, acrylonitrile-styrene-butadiene copolymers, styrene-acrylonitrile copolymers, ethylene-vinyl acetate copolymers are preferably used because they have good barrier properties to gases.

These polymers do not have photoconductivity, which the charge transporting polymer materials have. In the present invention, the polymers not having photoconductivity are referred to as "electrically inactive polymers".

Next, a single layer type photoconductive layer 24 is explained.

The single layer type photoconductive layer 24 includes at least a charge transporting polymer material. The photoconductive layer 24 can be formed by preparing a coating liquid in which a charge transporting polymer material is dissolved or dispersed in a solvent, and then coating the coating liquid and drying.

Suitable charge generating materials and charge transporting materials for use in the single layer type photoconductive layer 24 include those described above for use in the charge generating layer 22 and charge transporting layer 23 of the multi-layer type photoconductive layer. In addition, an antioxidant, a plasticizer, a lubricant, an ultraviolet absorbing agent and/or a leveling agent which are mentioned above, can also be used. Further, a binder resin, which is descried above for use in the charge transporting layer 23, can be added. Furthermore, a binder resin, which is descried for use in the charge generating layer 22, may also be added. The thickness of the single layer type photoconductive layer 24 is preferably from about 5 to about 100 $\mu$m, and more preferably from about 10 to about 40 $\mu$m.

The photoconductors of the present invention may include an undercoat layer 25 which is formed between the electric conductive substrate 21 and the photoconductive layer 24 to improve adhesion between them and coating properties of a layer to be formed on the substrate, and to prevent occurrence of an image defect "moiré". In addition, the undercoat layer 25 is formed to decrease a residual potential of the photoconductor and prevent the injection of charges from the electroconductive substrate 21. In general, the undercoat layer 25 mainly includes a resin. Since the photoconductive layer 24 is typically formed by coating a coating liquid including an organic solvent, the resin for use in the undercoat layer 25 preferably has good resistance to general organic solvents. Specific examples of such resins include water-soluble resins such as polyvinyl alcohol, casein, polyacrylic acid sodium salts, and the like; alcohol-soluble resins such as nylon copolymers, methoxymethylated nylon, and the like; and crosslinking resins, which can form a three-dimensional network, such as polyurethane resins, melamine resins, alkyd-melamine resins, epoxy resins, and the like. In addition, fine powders of metal oxides such as titanium oxide, silica, alumina, zirconium oxide, tin oxide, indium oxide and the like; metal sulfides, and metal nitrides can be added thereto. The undercoat layer 25 can be formed by a coating method using a proper solvent.

A metal oxide layer which is formed by a sol-gel method using a coupling agent such as a silane coupling agent, titan coupling agent and a chrome coupling agent can also be used as the undercoat layer 25. In addition, an alumina layer which is formed by an anodizing method, and a layer which is formed by a vacuum evaporation method using an organic material such as polyparaxylene (Palylene) or an inorganic material such as SiO, $SnO_2$, $TiO_2$, ITO, $CeO_2$ and the like. The thickness of the undercoat layer 25 is preferably from 0 to about 5 $\mu$m.

The photoconductors of the present invention may include a protective layer 26 formed on the photoconductive layer 24 to protect the photoconductive layer 24. The protective layer 26 mainly includes a resin. Specific examples of such a resin include ABS resins, ACS resins, olefin-vinyl monomer copolymers, chlorinated polyether resins, aryl resins, phenolic resins, polyacetal resins, polyamide resins, polyamideimide resins, polyacrylate resins, polyaryl sulfone resins, polybutylene resins, polybutylene terephthalate resins, polycarbonate resins, polyether sulfone resins, polyethylene resins, polyethylene terephthalate resins, polyimide resins, acrylic resins, polymethyl pentene resins, polypropylene resins, polyphenylene oxide resins, polysulfone resins, AS resins, AB resins, BS resins, polyurethane resins, polyvinyl chloride resins, polyvinylidene chloride resins, epoxy resins, and the like.

The protective layer 26 may include a resin such as fluorine-containing resins and silicone resins, which may include an inorganic material such as titanium oxide, tin oxide and potassium titanate, to improve abrasion resistance of the photoconductor.

The protective layer 26 is typically formed by a coating method. The thickness of the protective layer 26 is preferably from about 0.5 to about 10 μm. A layer which is formed by a vacuum evaporation method using i-C, and a-SiC can also be used as the protective layer 26.

In the present invention, an antioxidant, a plasticizer, a lubricant, an ultraviolet absorbing agent, a low molecular weight charge transporting material and a leveling agent can be added to each layer to mainly prevent decrease of photosensitivity and increase of a residual potential. Specific examples of such materials include materials which are described above for use in the charge transporting layer 23.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following undercoat layer coating liquid, charge generating layer coating liquid and charge transporting layer coating liquid were coated and dried one by one to overlay an undercoat layer of 3.5 μm thick, a charge generating layer of 0.2 μm thick and a charge transporting layer of 25 μm thick on an aluminum drum having a diameter of 100 mm. Thus, a photoconductor of the present invention was prepared.

| | |
|---|---|
| (Undercoat layer coating liquid) | |
| Alkyd resin (Bekkozol 1307-60-EL, manufactured by Dainippon Ink and Chemicals Inc.) | 6 |
| Melamine resin (Super Bekkamine G-821-60, manufactured by Dainippon Ink and Chemicals Inc.) | 4 |
| Titanium oxide | 40 |
| Methyl ethyl ketone | 200 |
| (Charge generating layer coating liquid) | |
| Trisazo dye having the following formula | 2.5 |

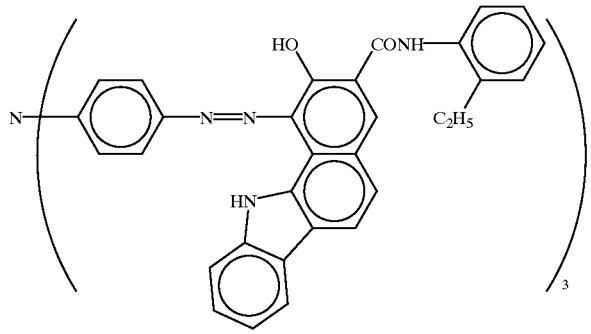

| | |
|---|---|
| Polyvinyl butyral resin (XYHL, manufactured by Union Carbide Corp.) | 0.25 |
| Cyclohexanone | 200 |
| Methyl ethyl ketone | 80 |
| (Charge transporting layer coating liquid) | |
| Charge transporting polymer material having the following formula | 10 |

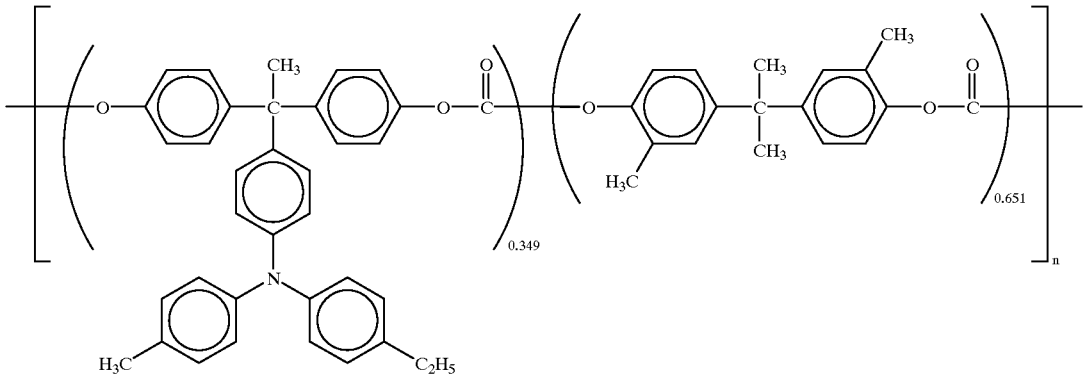

| | |
|---|---|
| Methylene chloride | 100 |

Example 2

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

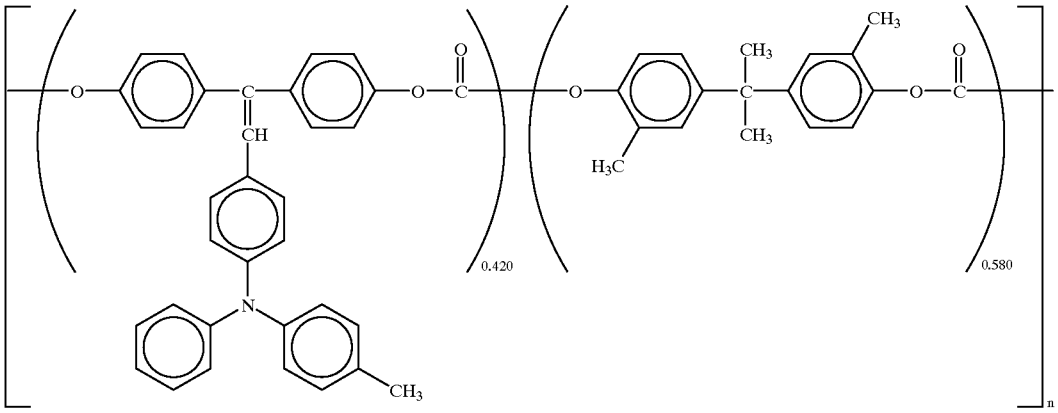

Example 3

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

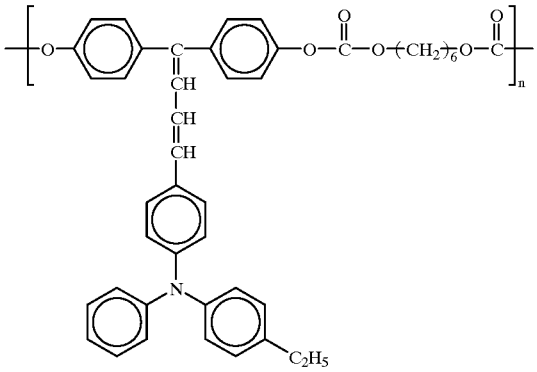

Example 4

The procedure for preparation of the photoconductor in Example 1 was repeated except that the charge transporting polymer material in the charge transporting layer coating-liquid was replaced with a charge transporting polymer material having the following formula, to prepare a photoconductor of the present invention.

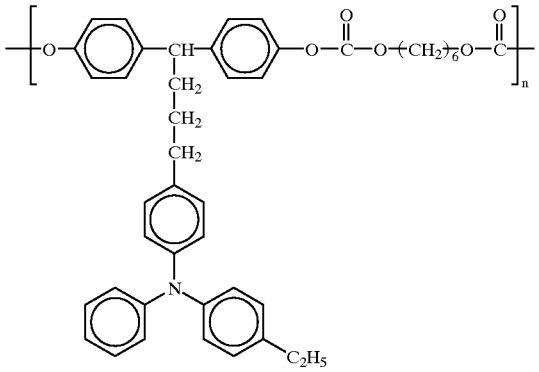

Example 5

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

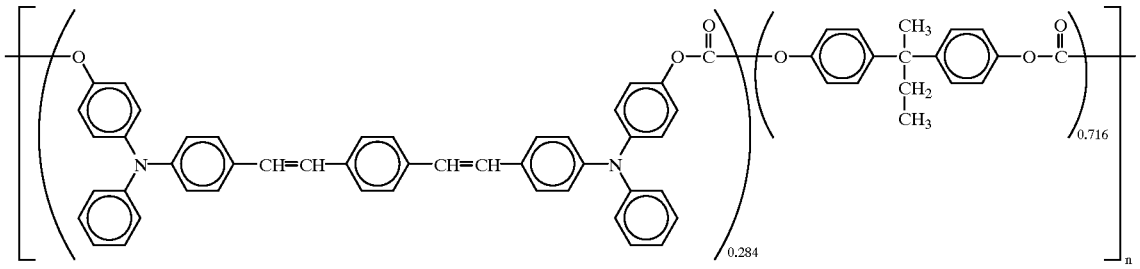

Example 6

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

Example 7

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

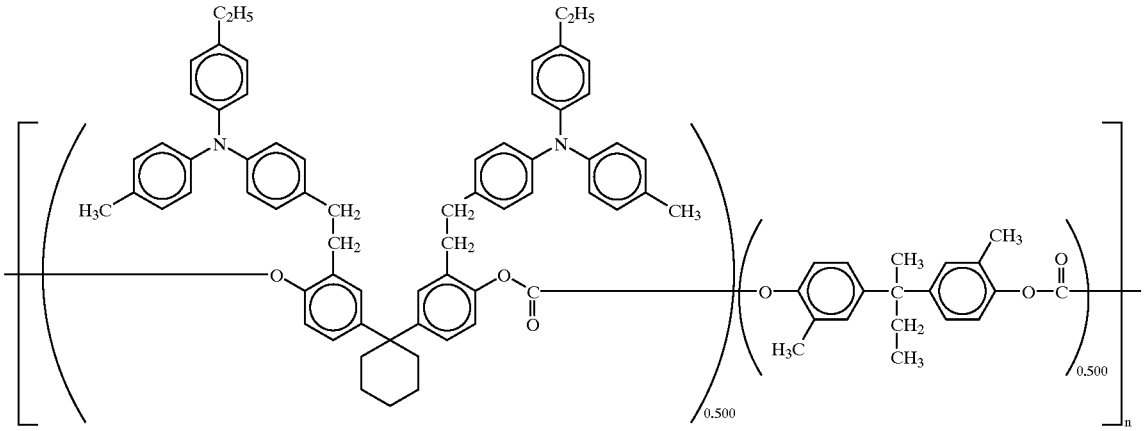

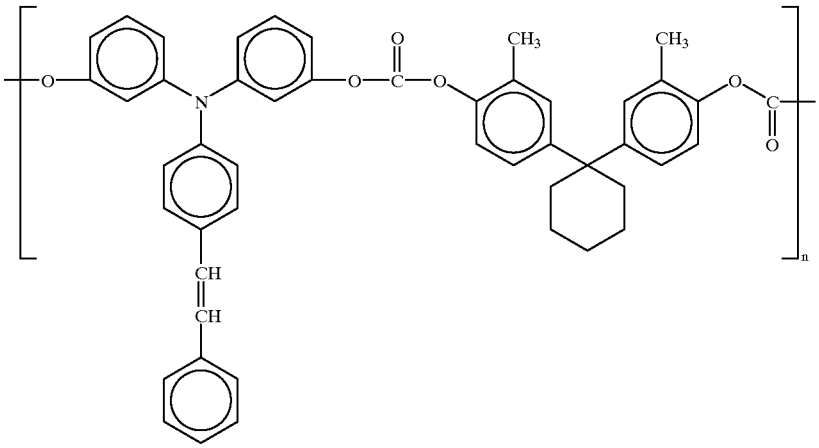

Example 8

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

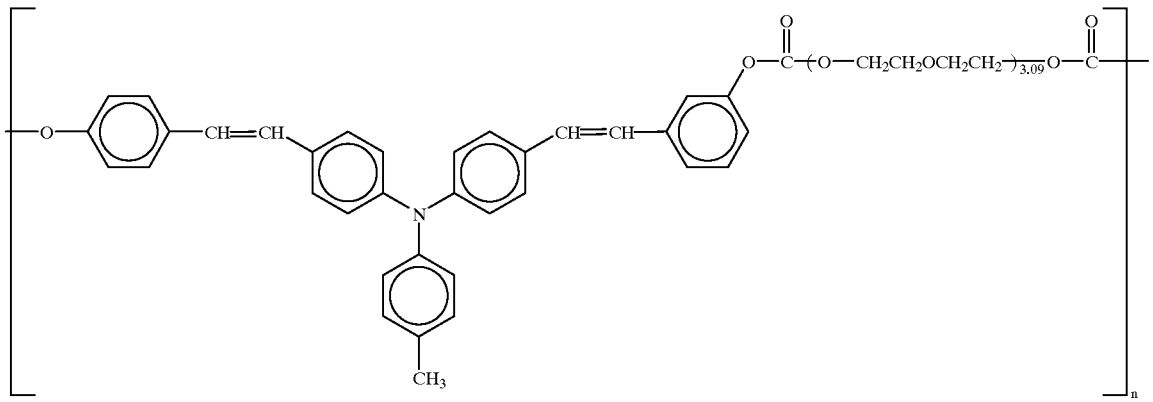

Example 9

The procedure for preparation of the photoconductor in Example 1 was repeated except that the charge transporting polymer material in the charge transporting layer coating liquid was replaced with a charge transporting polymer material having the following formula, to prepare a photoconductor of the present invention.

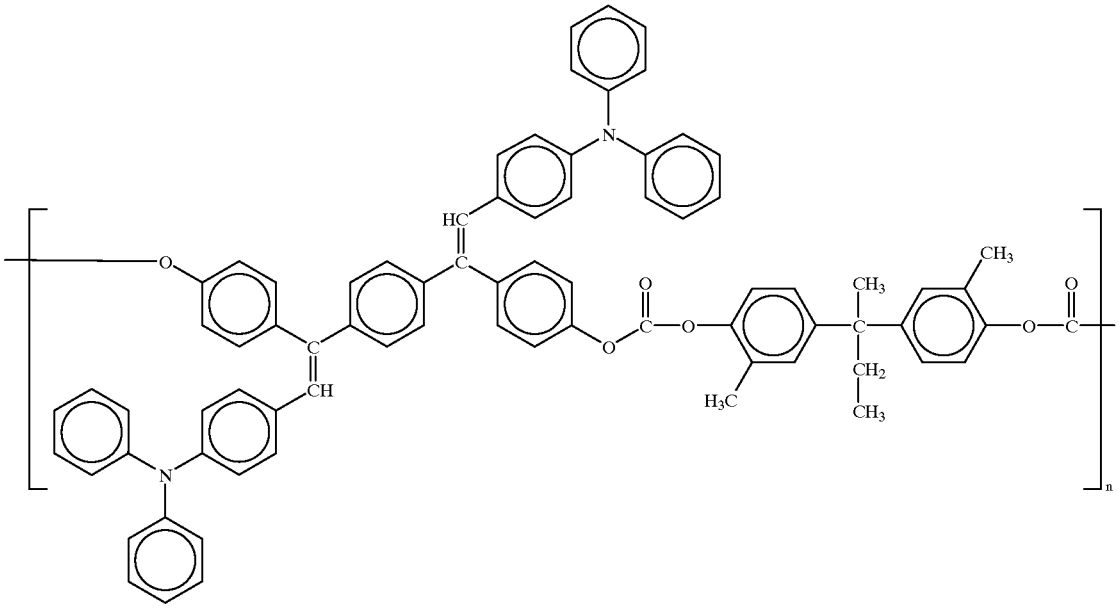

Example 10

The procedure for preparation of the photoconductor in Example 1 was repeated except that the polymer charge transporting material in the charge transporting layer coating liquid was replaced with a charge transporting polymer material having the following formula, to prepare a photoconductor of the present invention.

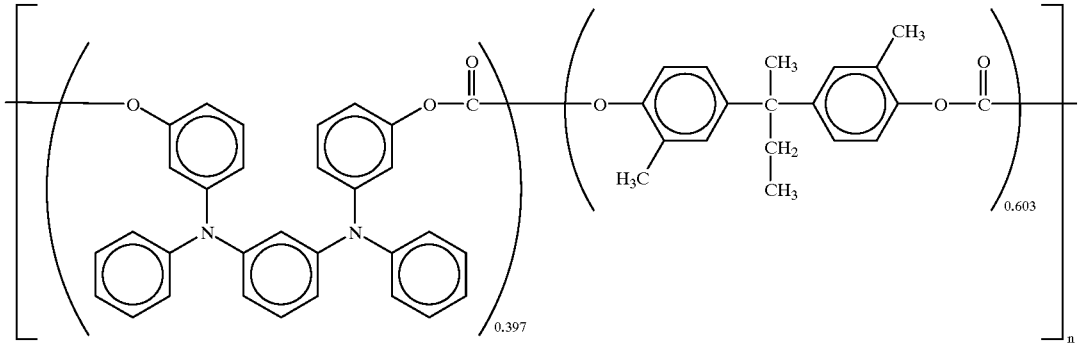

Comparative Example 1

The procedure for preparation of the photoconductor in Example 1 was repeated except that the charge transporting layer coating liquid was replaced with the following charge transporting layer coating liquid, to prepare a comparative photoconductor.

| (Charge transporting layer coating liquid) | |
|---|---|
| Bisphenol A type polycarbonate resin (Panlite K1300, manufactured by Teijin Ltd.) | 10 |
| Low molecular charge transporting material having the following formula | 10 |

-continued

| (Charge transporting layer coating liquid) | |
|---|---|
| 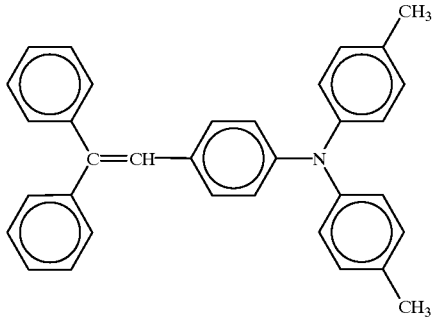 | |
| Methylene chloride | 100 |

Comparative Example 2

The procedure for preparation of the photoconductor in Example 1 was repeated except that the charge transporting layer coating liquid was replaced with the following charge transporting layer coating liquid, to prepare a comparative photoconductor.

| (Charge transporting layer coating liquid) | |
|---|---|
| Charge transporting polymer material having the following formula | 10 |
| 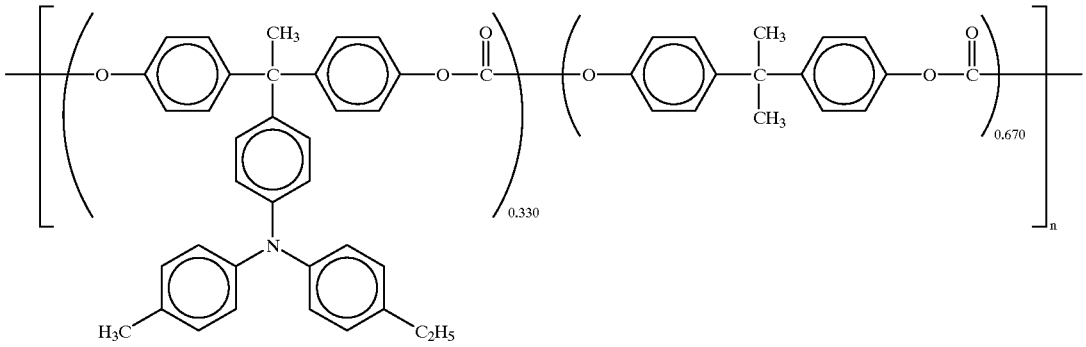 | |
| Methylene chloride | 100 |

Comparative Example 3

The procedure for preparation of the photoconductor in Example 1 was repeated except that the charge transporting layer coating liquid was replaced with the following charge transporting layer coating liquid, to prepare a comparative photoconductor.

| (Charge transporting layer coating liquid) | |
|---|---|
| Charge transporting polymer material having the following formula | 10 |
| 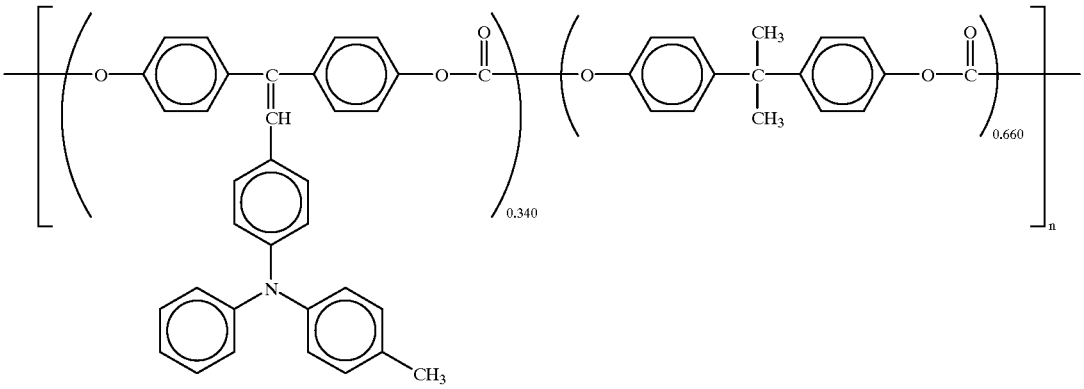 | |
| Methylene chloride | 100 |

The photoconductors of the present invention in Examples 1 to 10 and comparative photoconductors in Comparative Examples 1 to 3 were evaluated with respect to the following items:

(1) Water Vapor Permeability

Each charge transporting layer coating liquid in Examples 1 to 10 and Comparative Examples 1 to 3 was coated on an aluminum plate having a smooth surface and dried to form a charge transporting layer thereon. The thickness of the charge transporting layer was 25 μm. Each charge transporting layer formed on the aluminum plate was peeled from the plate and then the water vapor permeability was measured with a water vapor permeability measuring apparatus L80-4000 (manufactured by LYSSY Co.). The measuring method and conditions were as follows:

(a) Measuring Method

Measurements were performed by a method using a humidity sensor based on JIS K7192, "A testing method for measuring water vapor permeability of plastic films and sheets (mechanical measuring method)"

(b) Measuring Conditions

Measuring Temperature: 40±0.5° C.

(1) Thickness of Photoconductive Layer

The total thickness of the undercoat layer, the charge generating layer and the charge transporting layer of each photoconductor was measured with an eddy current type thickness measuring apparatus FISHER SCOPE MMS (manufactured by Fischer Co.). The total thickness of each photoconductor was determined by measuring the thickness of points of the photoconductor at intervals of 1 cm in the longitudinal direction of the photoconductor and then averaging the thickness.

(2) Charging Ability of Photoconductor

An electric potential of a central part of each photoconductor was measured using a modified copier, in which a probe of a surface potential meter Trek MODEL 344 (manufactured by Trek Co.) was provided at the developing unit of the copier, when each photoconductor was charged in the copier. The electric potential was also measured after the 100 hour running test which are mentioned below.

(3) Image Qualities

Each photoconductor was installed in a modified copier of a copier, IMAGIO DA355 manufactured by Ricoh Co., Ltd., and images were continuously reproduced for one hundred hours. The environmental conditions were 23° C. in temperature and 67% RH in humidity. In addition, the initial thickness of the charge transporting layer of each photoconductor was 25.0±0.2 μm. The air exhausting fan of the copier was stopped to clarify the difference of performance of the photoconductors.

The image qualities of the initial images and the final images produced by each photoconductor were visually evaluated.

(5) Amount of Abrasion

An amount of abrasion of each photoconductive layer was determined as the difference between the initial thickness of the photoconductive layer and the thickness thereof after the running test.

The results are shown in Table 1.

TABLE 1

| | Initial Potential (−V) | Potential After the running test (−V) | An amount of abrasion (μm) | Water vapor permeability $g \cdot m^{-2} \cdot 24h^{-1}$ | Initial image qualities | Image qualities after running test |
|---|---|---|---|---|---|---|
| Ex. 1 | 850 | 785 | 0.9 | 101.3 | good | Good |
| Ex. 2 | 850 | 774 | 0.8 | 123.2 | good | Good |
| Ex. 3 | 850 | 771 | 0.9 | 149.8 | good | Good |
| Ex. 4 | 850 | 767 | 0.7 | 126.4 | good | Good |
| Ex. 5 | 850 | 791 | 1.0 | 105.6 | good | Good |
| Ex. 6 | 850 | 783 | 0.9 | 132.5 | good | Good |
| Ex. 7 | 850 | 775 | 0.9 | 130.1 | good | Good |
| Ex. 8 | 850 | 780 | 1.0 | 125.0 | good | Good |
| Ex. 9 | 850 | 781 | 1.0 | 110.8 | good | Good |
| Ex. 10 | 850 | 780 | 0.8 | 109.7 | good | Good |
| Comparative Ex. 1 | 850 | 796 | 3.5 | 30.0 | good | Stream occurred caused a crack |
| Comparative Ex. 2 | 850 | 732 | 1.0 | 210.7 | good | Background fouling |
| Comparative Ex. 3 | 850 | 716 | 0.8 | 223.0 | Slight background fouling | Background fouling |

The results in Table 1 clearly indicate that the photoconductors of the present invention which have a water vapor permeability not greater than 200 $g \cdot m^{-2} \cdot 24\ h^{-1}$ can produce images having good image qualities without image defects such as background fouling. In addition, the results also indicate that the photoconductors of the present invention have good abrasion resistance.

Further, as can be understood from the comparison of the photoconductor in Example 1 with that in Comparative Example 2, and the comparison of the photoconductor in Example 2 with that in Comparative Example 3, the water vapor permeability of the charge transporting layer varies largely depending on the skeleton of the repeating unit of the polymer included in the charge transporting layer, which repeating unit does not have a charge transporting property. When the water vapor permeability of films of a bisphenol A type polycarbonate resin and a poly[2,2-bis(3-methyl-4-hydroxyphenyl)propanecarbonate resin, each thickness of which was 25 μm, was measured, the water vapor permeability thereof was 195 $g \cdot m^{-2} \cdot 24\ h^{-1}$ and 30 $g \cdot m^{-2} \cdot 24\ h^{-1}$, respectively. Therefore, it can be understood that when a charge transporting polymer material which is copolymerized with a resin component having a good barrier property to gases is used in the charge transporting layer, the resultant charge transporting layer has a relatively low water vapor permeability.

Example 11

The procedure for preparation of the photoconductor in Example 1 was repeated except that the charge transporting layer coating liquid was replaced with the following charge transporting layer coating liquid, to prepare a photoconductor of the present invention.

(Charge transporting layer coating liquid)

Charge transporting polymer material having the following formula 10

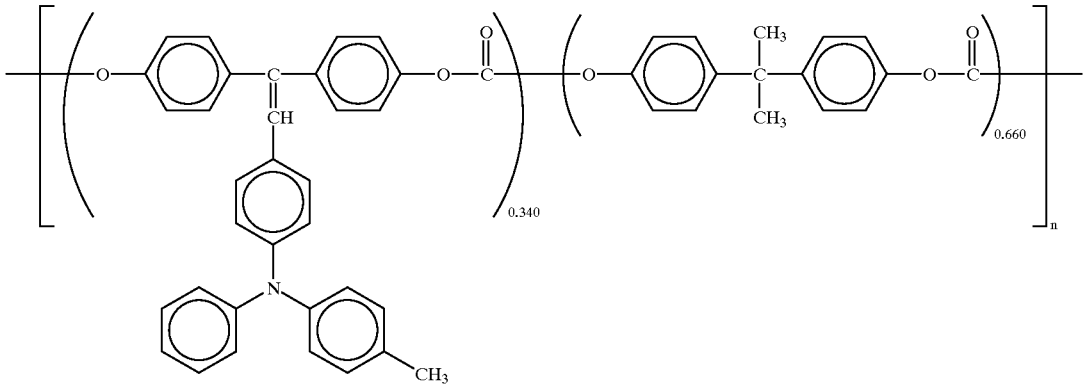

-continued

| (Charge transporting layer coating liquid) | |
|---|---|
| Sumiliizer BP76 (n-octadecyl-3-(4'-hydroxy-3',5'-di-t-butylphenol)propionate) (antioxidant, manufactured by Sumitomo Chemical Industries Inc.) | 0.5 |
| Methylene chloride | 100 |

Example 12

The procedure for preparation of the photoconductor in Example 11 was repeated except that the antioxidant was replaced with a plasticizer, o-terphenyl, manufactured by Tokyo Kasei Co., Ltd., to prepare a photoconductor of the present invention.

Example 13

The procedure for preparation of the photoconductor in Example 11 was repeated except that the antioxidant was replaced with a lubricant, butyl stearate, manufactured by Tokyo Kasei Co., Ltd., to prepare a photoconductor of the present invention.

Example 14

The procedure for preparation of the photoconductor in Example 11 was repeated except that the antioxidant was replaced with an ultraviolet absorbing agent, bis(1,2,2,6,6-pentamethyl-4-piperidyl)sebacate (Sanol LS-765 manufactured by Sankyo Co., Ltd.), to prepare a photoconductor of the present invention.

Example 15

The procedure for preparation of the photoconductor in Example 11 was repeated except that the antioxidant was replaced with a low molecular charge transporting material having the following formula, to prepare a photoconductor of the present invention.

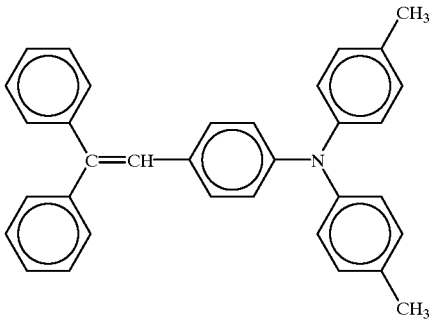

Example 16

The procedure for preparation of the photoconductor in Example 11 was repeated except that the antioxidant was replaced with an electrically inactive polymer material having the following formula, to prepare a photoconductor of the present invention.

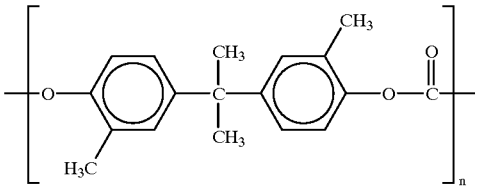

Example 17

The procedure for preparation of the photoconductor in Example 11 was repeated except that the antioxidant was replaced with a plasticizer, di-2-ethylhexyl phthalate manufactured by Tokyo Kasei Co., Ltd, to prepare a photoconductor of the present invention.

Example 18

The procedure for preparation of the photoconductor in Example 1 was repeated except that the charge transporting layer coating liquid was replaced with the following charge transporting layer coating liquid, to prepare a photoconductor of the present invention.

| (Charge transporting layer coating liquid) | |
|---|---|
| Charge transporting polymer material having the following formula | 8 |
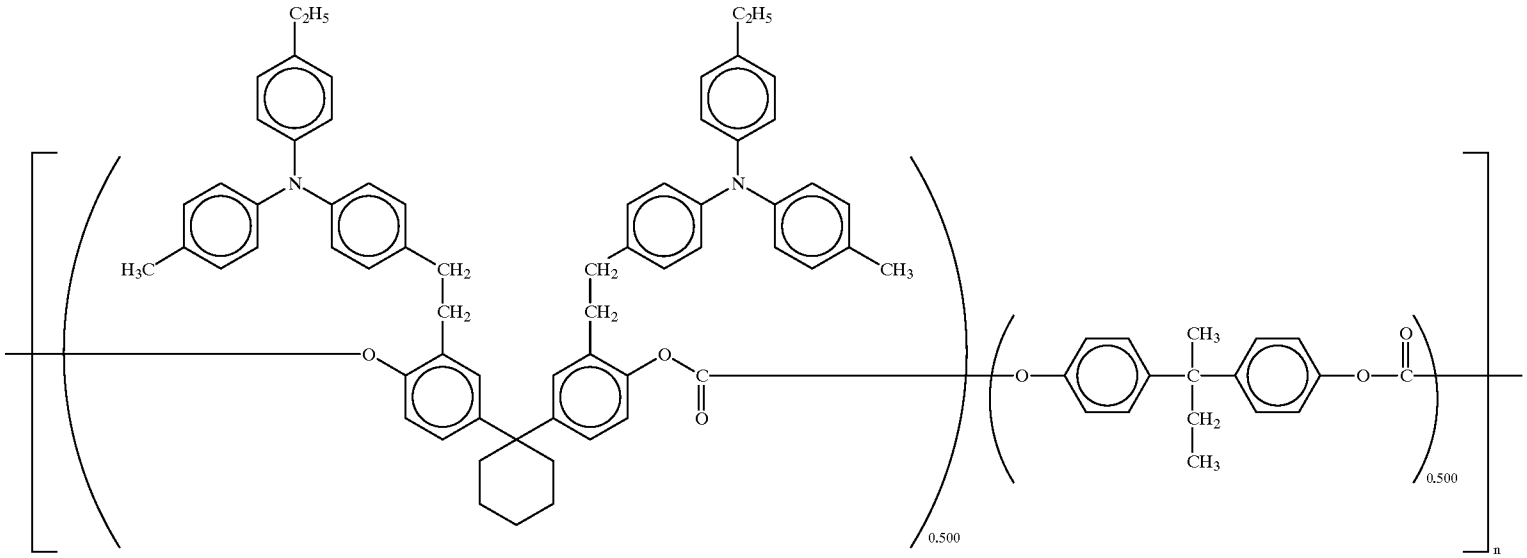
| | |
|---|---|
| Electrically inactive polymer having the following formula | 2 |
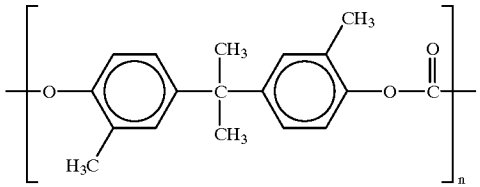
| | |
|---|---|
| Methylene chloride | 100 |

Example 19

The procedure for preparation of the photoconductor in Example 1 was repeated except that the charge transporting layer coating liquid was replaced with the following charge transporting layer coating liquid, to prepare a photoconductor of the present invention.

| (Charge transporting layer coating liquid) | |
|---|---|
| Charge transporting polymer material having the following formula | 10 |

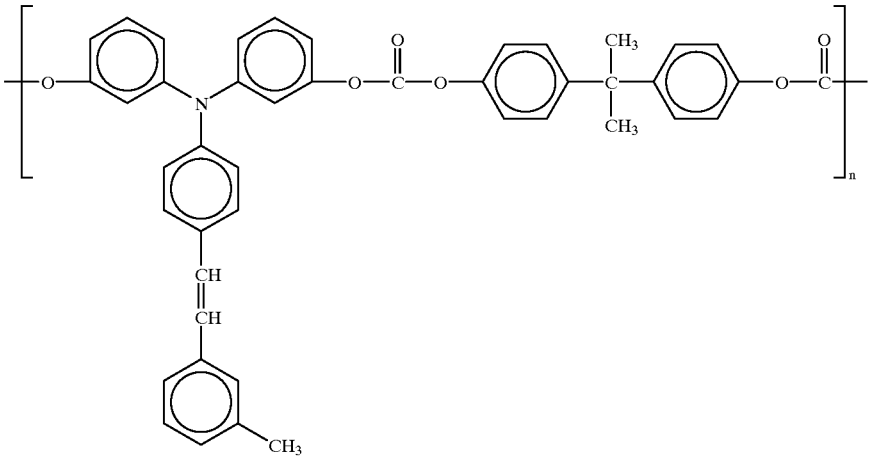

| | |
|---|---|
| Butyl oleate (plasticizer) (manufactured by Tokyo Kasei Co., Ltd.) | 0.5 |
| Methylene chloride | 100 |

Example 20

The procedure for preparation of the photoconductor in Example 1 was repeated except that the charge transporting layer coating liquid was replaced with the following charge transporting layer coating liquid, to prepare a photoconductor of the present invention.

| (Charge transporting layer coating liquid) | |
|---|---|
| Charge transporting polymer material having the following formula | 10 |

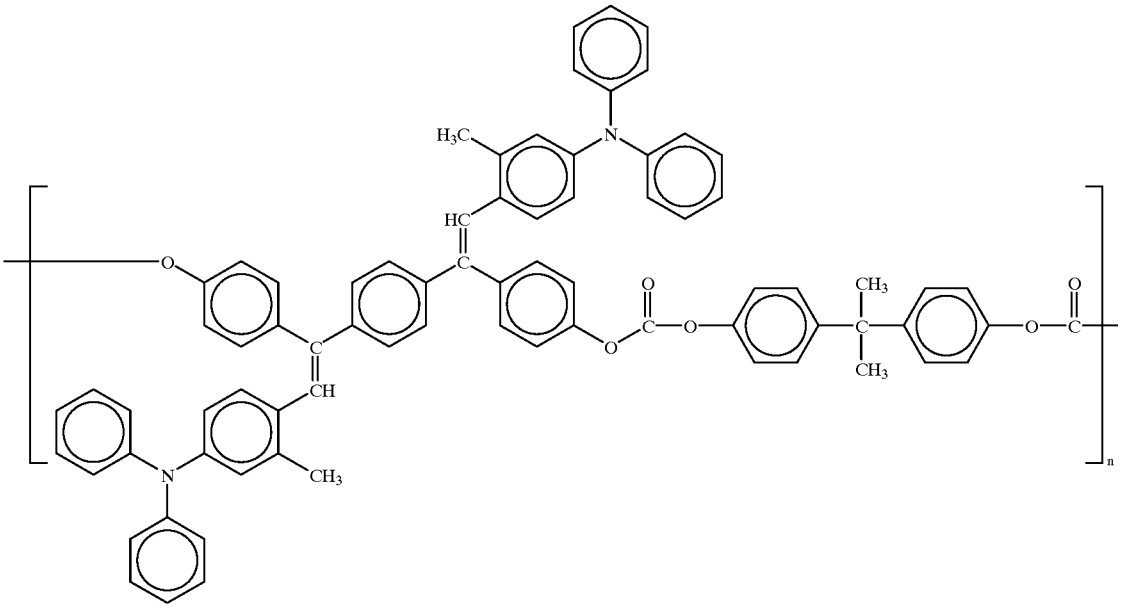

| | |
|---|---|
| Butyl stearate (lubricant) (manufactured by Tokyo Kasei Co., Ltd.) | 0.5 |
| Methylene chloride | 100 |

Example 21

The procedure for preparation of the photoconductor in Example 1 was repeated except that the charge transporting layer coating liquid was replaced with the following charge transporting layer coating liquid, to prepare a photoconductor of the present invention.

| (Charge transporting layer coating liquid) | |
|---|---|
| Charge transporting polymer material having the following formula | 10 |

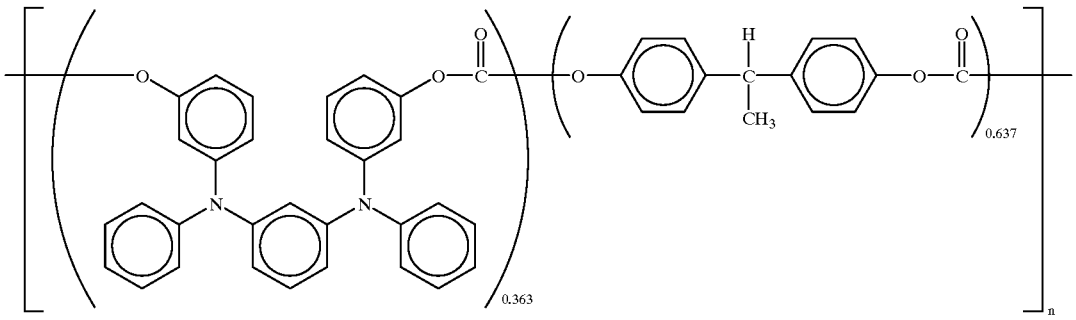

| | |
|---|---|
| Low molecular charge transporting material having the following formula | 0.5 |

-continued

| (Charge transporting layer coating liquid) | |
|---|---|
| 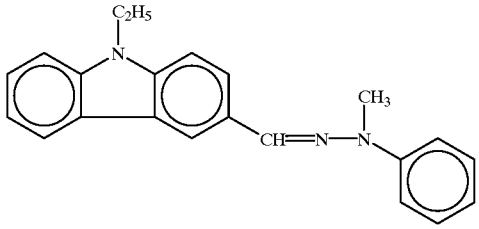 | |
| Methylene chloride | 100 |

Example 22

The procedure for preparation of the photoconductor in Example 1 was repeated except that the charge transporting layer coating liquid was replaced with the following charge transporting layer coating liquid, to prepare a photoconductor of the present invention.

Example 23

The procedure for preparation of the photoconductor in Example 1 was repeated except that the charge transporting layer coating liquid was replaced with the following charge transporting layer coating liquid, to prepare a photoconductor of the present invention.

| Charge transporting layer coating liquid | |
|---|---|
| Charge transporting polymer material having the following formula | 6 |
| 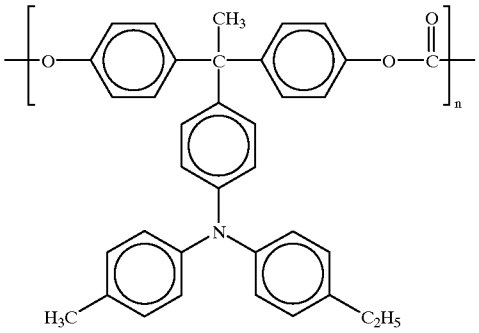 | |
| Charge transporting polymer material having the following formula | 4 |
| 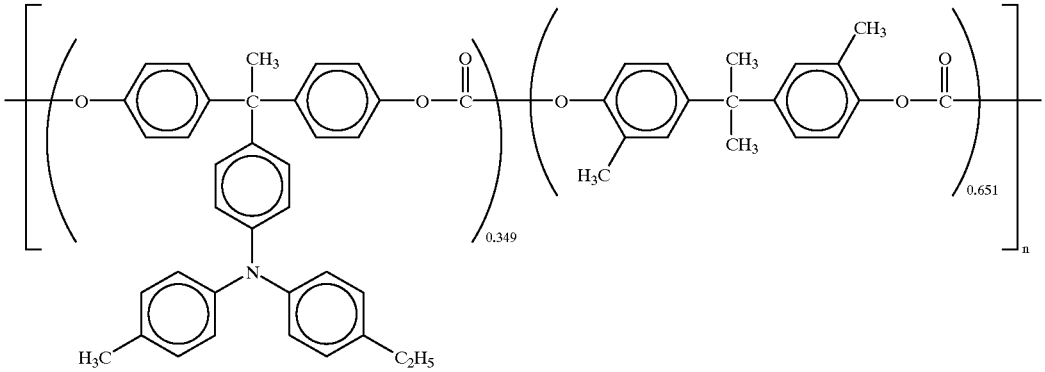 | |
| Methylene chloride | 100 |

| Charge transporting layer coating liquid | |
|---|---|
| Charge transporting polymer material having the following formula | 5 |
| 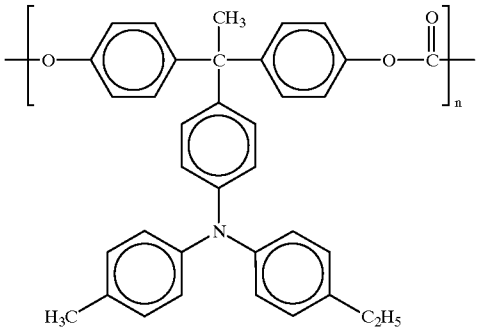 | |
| Charge transporting polymer material having the following formula | 5 |
| 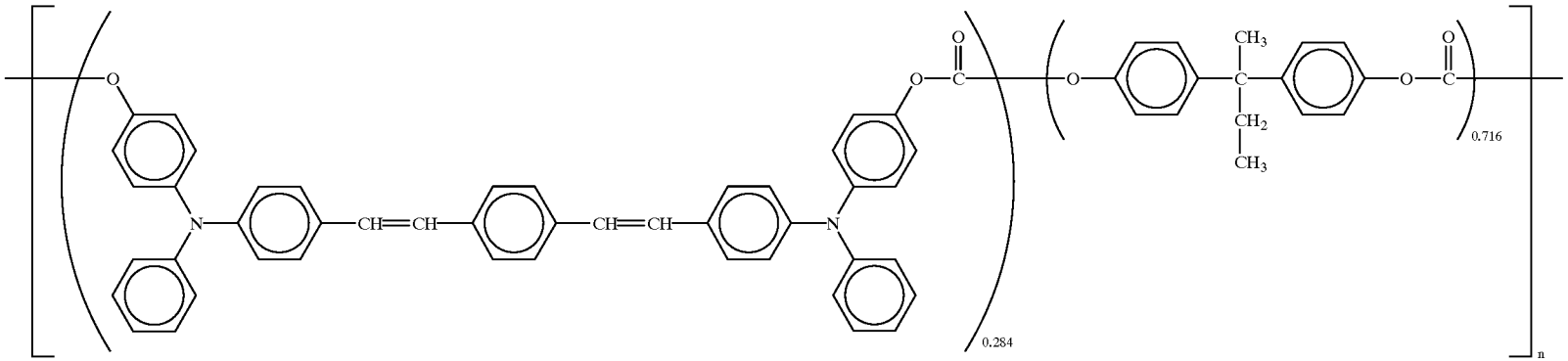 | |
| Methylene chloride | 100 |

Example 24

The procedure for preparation of the photoconductor in Example 1 was repeated except that the charge transporting layer coating liquid was replaced with the following charge transporting layer coating liquid, to prepare a photoconductor of the present invention.

| Charge transporting layer coating liquid | |
|---|---|
| Charge transporting polymer material having the following formula | 5 |
| 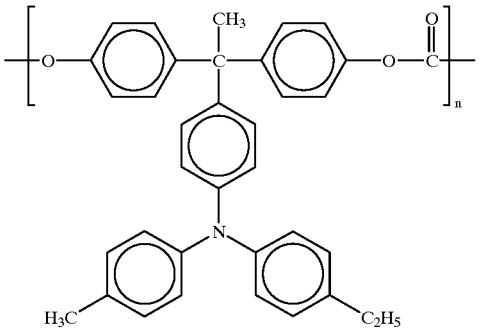 | |
| Electrically inactive polymer material having the following formula | 5 |

-continued

| Charge transporting layer coating liquid | |
|---|---|
| 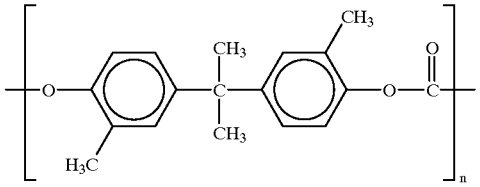 | |
| Methylene chloride | 100 |

Comparative Example 4

The procedure for preparation of the photoconductor in Example 1 was repeated except that the charge transporting layer coating liquid was replaced with the following charge transporting layer coating liquid, to prepare a comparative photoconductor.

| | | |
|---|---|---|
| Charge transporting layer coating liquid | 10 | 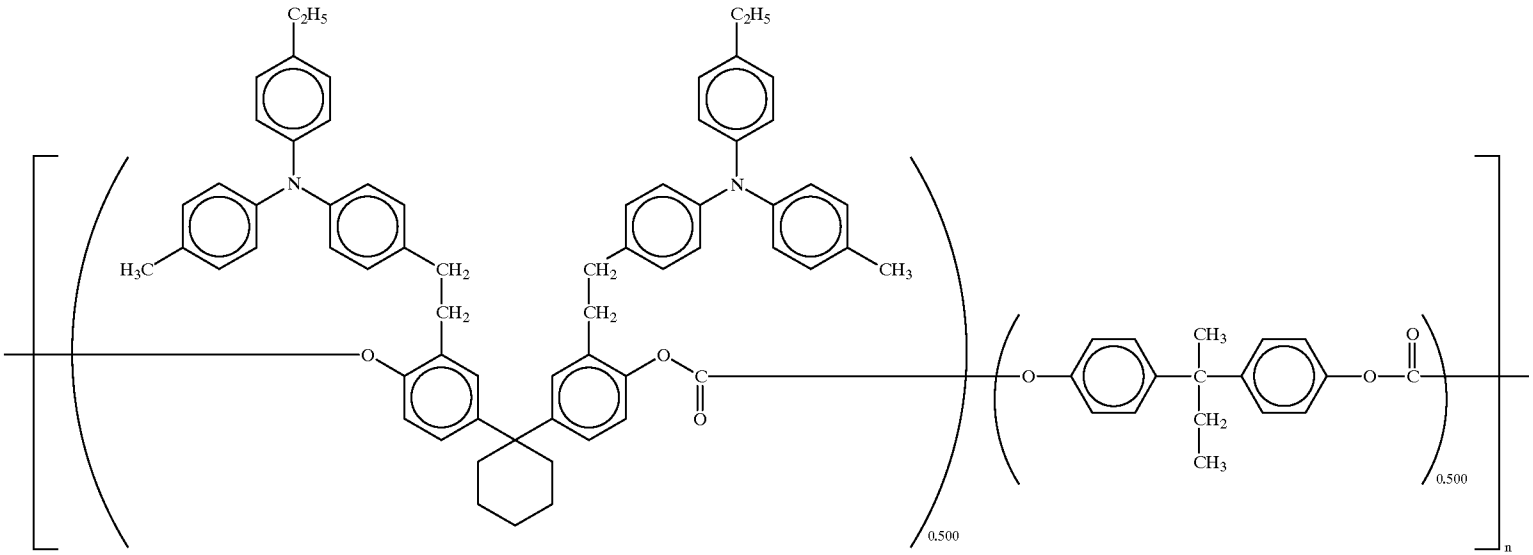 |
| Charge transporting polymer material having the following formula | | 100 |
| | | Methylene chloride |

Comparative Example 5

The procedure for preparation of the photoconductor in Example 1 was repeated except that the charge transporting layer coating liquid was replaced with the following charge transporting layer coating liquid, to prepare a comparative photoconductor.

| Charge transporting layer coating liquid | |
|---|---|
| Charge transporting polymer material having the following formula | 10 |
| 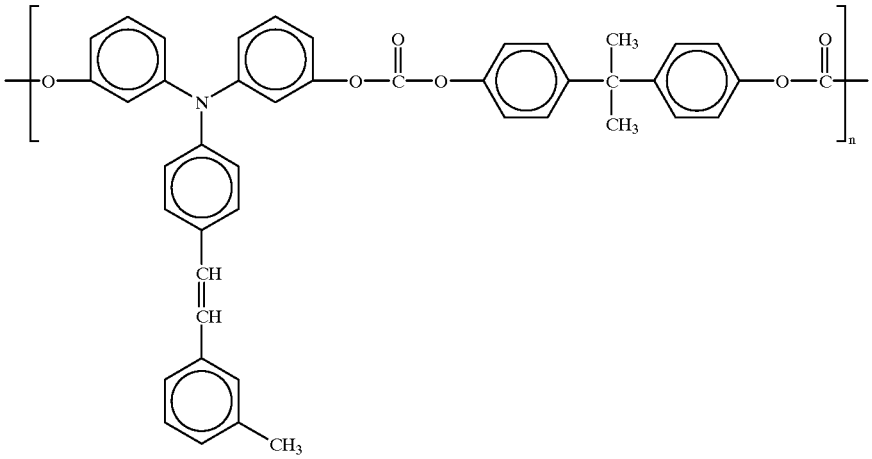 | |
| Methylene chloride | 100 |

Comparative Example 6

The procedure for preparation of the photoconductor in Example 1 was repeated except that the charge transporting layer coating liquid was replaced with the following charge transporting layer coating liquid, to prepare a comparative photoconductor.

| Charge transporting layer coating liquid | |
|---|---|
| Charge transporting polymer material having the following formula | 10 |
| 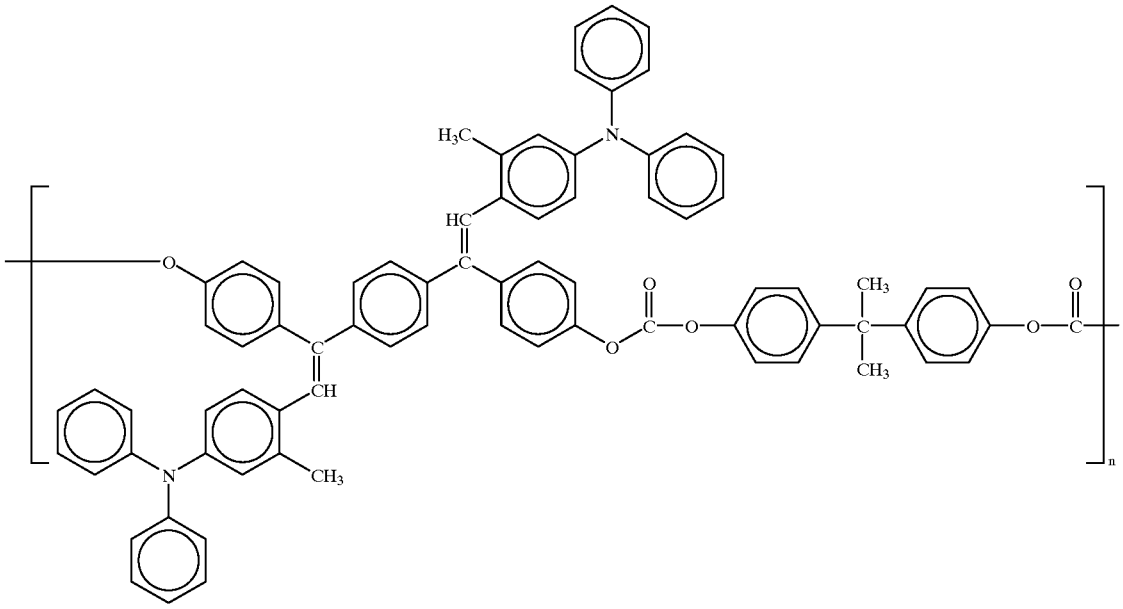 | |
| Methylene chloride | 100 |

Comparative Example 7

The procedure for preparation of the photoconductor in Example 1 was repeated except that the charge transporting layer coating liquid was replaced with the following charge transporting layer coating liquid, to prepare a comparative photoconductor.

| Charge transporting layer coating liquid | |
|---|---|
| Charge transporting polymer material having the following formula | 10 |
| 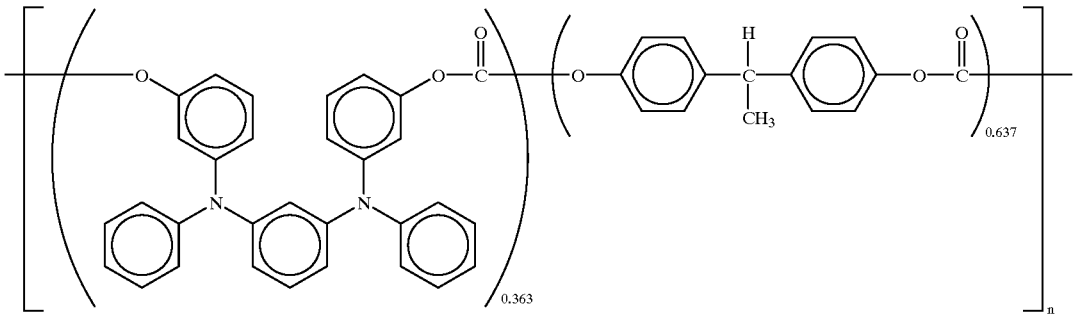 | |
| Methylene chloride | 100 |

Comparative Example 8

The procedure for preparation of the photoconductor in Example 1 was repeated except that the charge transporting layer coating liquid was replaced with the following charge transporting layer coating liquid, to prepare a comparative photoconductor.

| Charge transporting layer coating liquid | |
|---|---|
| Charge transporting polymer material having the following formula | 10 |

-continued

| Charge transporting layer coating liquid | |
|---|---|
| 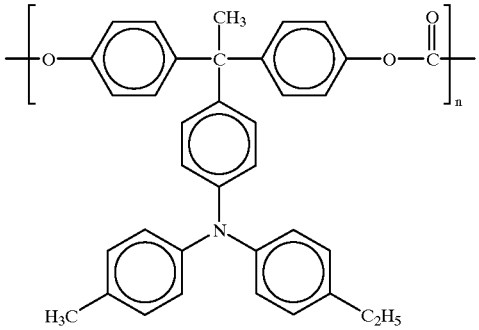 | |
| Methylene chloride | 100 |

The photoconductors of the present invention in Examples 11 to 24 and comparative photoconductors in Comparative Examples 3 to 8 were also evaluated by the methods mentioned above. The results are shown in Table 2.

TABLE 2

| | Initial Potential (−V) | Potential After the running test (−V) | An amount of abrasion (μm) | Water vapor permeability $g \cdot m^{-2} \cdot 24h^{-1}$ | Initial image qualities | Image qualities after running test |
|---|---|---|---|---|---|---|
| Ex. 11 | 850 | 780 | 0.8 | 135.2 | good | Good |
| Ex. 12 | 850 | 778 | 0.8 | 106.8 | good | Good |
| Ex. 13 | 850 | 773 | 0.8 | 120.2 | good | Good |
| Ex. 14 | 850 | 774 | 0.9 | 125.3 | good | Good |
| Ex. 15 | 850 | 770 | 0.9 | 122.2 | good | Good |
| Ex. 16 | 850 | 776 | 0.8 | 128.6 | good | Good |
| Ex. 17 | 850 | 775 | 0.8 | 130.1 | good | Good |
| Comparative Ex. 3 | 850 | 716 | 0.8 | 223.0 | Slight background fouling | Background fouling |
| Ex. 18 | 850 | 770 | 1.0 | 190.5 | good | Good |
| Comparative Ex. 4 | 850 | 710 | 0.9 | 232.1 | very slight background fouling | Background fouling |
| Ex. 19 | 850 | 772 | 0.9 | 118.6 | good | Good |
| Comparative Ex. 5 | 850 | 726 | 0.9 | 207.7 | very slight background fouling | Background fouling |
| Ex. 20 | 850 | 786 | 1.0 | 119.2 | good | Good |
| Comparative Ex. 6 | 850 | 731 | 1.0 | 205.1 | Very slight background fouling | Background fouling |
| Ex. 21 | 850 | 781 | 1.0 | 108.8 | good | Good |
| Ex. 22 | 850 | 766 | 1.0 | 180.6 | Good | Good |
| Ex. 23 | 850 | 773 | 1.2 | 170.3 | Good | Good |
| Ex. 24 | 850 | 782 | 1.0 | 130.6 | Good | Good |
| Comparative Ex. 7 | 850 | 729 | 1.0 | 222.3 | Slight background fouling | Background fouling |
| Comparative Ex. 8 | 850 | 720 | 1.3 | 220.1 | slight background fouling | Background fouling |

The results in Table 2 clearly indicate that the charge transporting layer consisting of the charge transporting polymer material having a water vapor permeability greater than 200 $g \cdot m^{-2} \cdot 24\ h^{-1}$ can have a water vapor permeability not greater than 200 $g \cdot m^{-2} \cdot 24\ h^{-1}$ when a low molecular compound such as an antioxidant, a plasticizer, a lubricant, an ultraviolet absorbing agent, a low molecular charge transporting material, or a polymer compound having good gas barrier property is added to the charge transporting layer. These photoconductors can produce images having good image qualities without image defects such as background fouling.

Example 25

The procedure for preparation of the photoconductor in Comparative Example 5 was repeated except that the thickness of the charge transporting layer was changed to 30 $\mu$m. The water vapor permeability of the charge transporting layer was 175 $g \cdot m^{-2} \cdot 24\ h^{-1}$. Thus, a photoconductor of the present invention was prepared.

Example 26

The procedure for preparation of the photoconductor in Comparative Example 5 was repeated except that the thickness of the charge transporting layer was changed to40 $\mu$m. The water vapor permeability of the charge transporting layer was 135.5 $g \cdot m^{-2} \cdot 24\ h^{-1}$. Thus, a photoconductor of the present invention was prepared.

Comparative Example 9

The procedure for preparation of the photoconductor in Comparative Example 5 was repeated except that the thickness of the charge transporting layer was changed to 20 $\mu$m. The water vapor permeability of the charge transporting layer was 256.3 $g \cdot m^{-2} \cdot 24\ h^{-1}$. Thus, a comparative photoconductor was prepared.

Example 27

The procedure for preparation of the photoconductor in Comparative Example 5 was repeated except that the thickness of the charge transporting layer was changed to 50 $\mu$m. The water vapor permeability of the charge transporting layer was 108.6 $g \cdot m^{-2} \cdot 24\ h^{-1}$. Thus, a photoconductor of the present invention was prepared.

Example 28

The procedure for preparation of the photoconductor in Comparative Example 5 was repeated except that the thickness of the charge transporting layer was changed to 60 $\mu$m. The water vapor permeability of the charge transporting layer was 92.7 $g \cdot m^{-2} \cdot 24\ h^{-1}$. Thus, a photoconductor of the present invention was prepared.

The photoconductors of the present invention in Examples 24 to 28 and comparative photoconductors in Comparative Example 9 were also evaluated by the methods mentioned above. The results are shown in Table 3.

TABLE 3

| | Thickness of charge transporting layer ($\mu$m) | Water vapor permeability | Background fouling of images | Resolution of images |
|---|---|---|---|---|
| Comparative EX. 9 | 20 | 256.3 | Slight background fouling | Good |
| Comparative EX. 5 | 25 | 207.7 | Very slight background fouling | Good |
| EX. 25 | 30 | 175.0 | Good | Good |
| EX. 26 | 40 | 135.5 | Good | Good |
| EX. 27 | 50 | 108.6 | Good | Line images were slightly broadened |
| EX. 28 | 60 | 92.7 | Good | Line images were broadened |

The results in Table 3 clearly indicate that the thicker the charge transporting layer, the greater the water vapor permeability of the resultant photoconductors, and the photoconductors having a water vapor permeability not greater than 200 $g \cdot m^{-2} \cdot 24\ h^{-1}$ produce images having good image qualities such as good resolution without background fouling. In particular, when the thickness of the charge transporting layer is not greater than 40 $\mu$m, the resultant photoconductors produce images having good resolution.

Example 29

The procedure for preparation of the photoconductor in Example 15 was repeated except that the addition amount of the charge transporting polymer material was changed from 10 to 9 parts and the addition amount of the low molecular charge transporting material was changed from 0.5 to 1 part. The water vapor permeability of the charge transporting layer was 90.2 $g \cdot m^{-2} \cdot 24\ h^{-1}$. Thus, a photoconductor of the present invention was prepared.

Example 30

The procedure for preparation of the photoconductor in Example 15 was repeated except that the addition amount of the charge transporting polymer material was changed to 8 parts and the addition amount of the low molecular charge transporting material was changed to 2 parts. The water vapor permeability of the charge transporting layer was 52.0 $g \cdot m^{-2} \cdot 24\ h^{-1}$. Thus, a photoconductor of the present invention was prepared.

Example 31

The procedure for preparation of the photoconductor in Example 15 was repeated except that the addition amount of the charge transporting polymer material was changed to 7 parts and the addition amount of the low molecular charge transporting material was changed to 3 parts. The water vapor permeability of the charge transporting layer was 24.2 $g \cdot m^{-2} \cdot 24\ h^{-1}$. Thus, a photoconductor of the present invention was prepared.

Example 32

The procedure for preparation of the photoconductor in Example 15 was repeated except that the addition amount of the charge transporting polymer material was changed to 6 parts and the addition amount of the low molecular charge transporting material was changed to 4 parts. The water vapor permeability of the charge transporting layer was 14.2 $g \cdot m^{-2} \cdot 24\ h^{-1}$. Thus, a photoconductor of the present invention was prepared.

Example 33

The procedure for preparation of the photoconductor in Example 15 was repeated except that the addition amount of the charge transporting polymer material was changed to 5 parts and the addition amount of the low molecular charge transporting material was changed to 5 parts. The water vapor permeability of the charge transporting layer was 10.2 $g \cdot m^{-2} \cdot 24\ h^{-1}$. Thus, a photoconductor of the present invention was prepared.

The photoconductors of the present invention in Examples 29 to 33 were also evaluated by the methods mentioned above. The results are shown in Table 4.

TABLE 4

| | Addition amount of low molecular compound (% by weight) | Water vapor permeability ($g \cdot m^{-2} \cdot 24h^{-1}$) | Abrasion ($\mu m$) | Initial image qualities | Image qualities after 100 hour running test |
|---|---|---|---|---|---|
| Comparative EX. 3 | 0 | 223.0 | 0.8 | Slight background fouling | Background fouling |
| EX. 15 | 4.8 | 122.2 | 0.9 | Good | Good |
| EX. 29 | 10 | 90.2 | 1.0 | Good | Good |
| EX. 30 | 20 | 52.0 | 1.3 | Good | Good |
| EX. 31 | 30 | 24.2 | 1.7 | Good | Good |
| EX. 32 | 40 | 14.2 | 2.7 | Good | Black streaks caused by cracks |
| EX. 33 | 50 | 10.2 | 3.8 | Good | Black streaks caused by cracks |

The results in Table 4 clearly indicate that the photoconductors having a water vapor permeability not greater than 200 $g \cdot m^{-2} \cdot 24\ h^{-1}$ can produce images having good image qualities such as good resolution without background fouling. In particular, when the addition amount of the low molecular charge transporting material is not greater than 30% by weight, the resultant photoconductors produce images without background fouling.

Example 34

The procedure for preparation of the photoconductor in Example 1 was repeated except that the thickness of the charge transporting layer was changed to 20 $\mu m$. The water vapor permeability of the charge transporting layer was 128.5 $g \cdot m^{-2} \cdot 24\ h^{-1}$. Thus, a photoconductor of the present invention was prepared.

Comparative Example 10

The procedure for preparation of the photoconductor in Comparative Example 2 was repeated except that the thickness of the charge transporting layer was changed to20 $\mu m$. The water vapor permeability of the charge transporting layer was 260.0 $g \cdot m^{-2} \cdot 24\ h^{-1}$. Thus, a photoconductor of the present invention was prepared.

The photoconductors of the present invention in Example 34 and Comparative Example 10 were also evaluated by the methods mentioned above. The results are shown in Table 5.

TABLE 5

| | Thickness of charge transporting layer ($\mu m$) | An amount of abrasion ($\mu m$) | Water vapor permeability ($g \cdot m^{-2} \cdot 24h^{-1}$) | Resolution of initial images | Background fouling images after running test |
|---|---|---|---|---|---|
| EX. 1 | 25 | 0.9 | 101.3 | Dots of images were slightly broadened | Good |
| EX. 34 | 20 | 0.9 | 128.5 | Good | Good |
| Comparative EX. 9 | 20 | 1.0 | 260.0 | Good | Background fouling |

When the thickness of the charge transporting layer is not greater than 20 $\mu$m, the resultant photoconductors produce images having very good resolution, and the photoconductors having a water vapor permeability not greater than 200 $g \cdot m^{-2} \cdot 24\ h^{-1}$ produce images having good image qualities such as good resolution without background fouling.

As described above, the photoconductors of the present invention have good charge properties and less abrasion, and therefore images having good image qualities without image defects such as background fouling can be obtained.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 10-22102, filed on Feb. 3, 1998, the entire contents of which are herein incorporated by reference.

What is claimed as new and is intended to be secured by Letters Patent is:

1. An apparatus, comprising an electrophotographic photoconductor comprising a photoconductive layer over an electroconductive substrate, wherein the photoconductive layer comprises a charge transporting polymer material, and wherein the photoconductive layer has a water vapor permeability not greater than about 200 $g \cdot m^{-2} \cdot 24\ h^{-1}$, wherein the photoconductive layer further comprises a low molecular weight compound having a molecular weight less than about 10,000, and wherein the low molecular weight compound is present in a charge transporting layer of the photoconductive layer in an amount of not greater than about 30% by weight, wherein said apparatus is selected from the group consisting of copiers, facsimile machines, laser printers and digital printing plate manufacturing apparatuses.

2. An apparatus, comprising an electrophotographic photoconductor comprising a photoconductive layer over an electroconductive substrate, wherein the photoconductive layer comprises a charge transporting polymer material, and wherein the photoconductive layer has a water vapor permeability not greater than about 200 $g \cdot m^{-2} \cdot 24\ h^{-1}$, wherein the charge transporting polymer material comprises a repeating unit having a triarylamine structure and a repeating unit having an electrically inactive structure, and wherein the repeating unit having an electrically inactive structure is selected from the group consisting of repeating units which form homopolymer films having a water vapor permeability not greater than about 120 $g \cdot m^{-2} \cdot 24\ h^{-1}$, when the same thickness as the charge transporting layer, and wherein said apparatus is selected from the group consisting of copiers, facsimile machines, laser printers and digital printing plate manufacturing apparatuses.

* * * * *